US011999526B2

(12) United States Patent
Su

(10) Patent No.: US 11,999,526 B2
(45) Date of Patent: Jun. 4, 2024

(54) FOLDABLE BOX

(71) Applicant: HOREN CORTP Co., LTD., Shanghai (CN)

(72) Inventor: Yongping Su, Shanghai (CN)

(73) Assignee: HOREN CORTP CO., LTD., Shanghai (CN)

( * ) Notice: Subject to any disclaimer, the term of this patent is extended or adjusted under 35 U.S.C. 154(b) by 11 days.

(21) Appl. No.: 17/596,569

(22) PCT Filed: Jun. 11, 2020

(86) PCT No.: PCT/CN2020/095615
§ 371 (c)(1),
(2) Date: Dec. 13, 2021

(87) PCT Pub. No.: WO2020/249047
PCT Pub. Date: Dec. 17, 2020

(65) Prior Publication Data

US 2022/0297882 A1 Sep. 22, 2022

(30) Foreign Application Priority Data

Jun. 13, 2019 (CN) ..... 201910511590.7

(51) Int. Cl.
*B65D 6/18* (2006.01)
*B65D 6/32* (2006.01)
(Continued)

(52) U.S. Cl.
CPC ..... *B65D 11/1833* (2013.01); *B65D 7/38* (2013.01); *B65D 25/24* (2013.01);
(Continued)

(58) Field of Classification Search
CPC ..... B65D 81/3818–3823; B65D 19/18
(Continued)

(56) References Cited

U.S. PATENT DOCUMENTS 4,693,386 A * 9/1987 Hughes ..... B65D 11/1833 220/6
5,000,372 A * 3/1991 Hollander ..... B65D 19/06 493/110

(Continued)

FOREIGN PATENT DOCUMENTS

CN 1104603 7/1995
CN 2372243 4/2000

(Continued)

OTHER PUBLICATIONS

International Search Report (with English translation) and Written Opinion issued in PCT/CN2020/095615, dated Sep. 23, 2020, 12 pages provided.

(Continued)

*Primary Examiner* — Mollie Impink
(74) *Attorney, Agent, or Firm* — HSML P.C.

(57) ABSTRACT

This application discloses a foldable box. The foldable box has a box body and a lid, wherein the box body has a base and a pair of opposing first side panels and a pair of opposing second side panels that are foldably connected to the base. One edge of the lid is hinged to the top of the box body. Each of the first side panel, the second side panel and the lid is formed by welding an inner plate and an outer plate, and a thermal insulation layer is arranged between the inner plate and the outer plate. The base has a plate-shaped body and a protruding edge extending upwardly from the circumference of the plate-shaped main body, and a thermal insulation layer is arranged in the plate-shaped body and the protruding edge. The foldable box of the present application can not only realize the folding function, but also has good thermal insulation performance.

15 Claims, 23 Drawing Sheets

(51) Int. Cl.

| | |
|---|---|
| ***B65D 25/24*** | (2006.01) |
| ***B65D 81/38*** | (2006.01) |
| ***B65D 85/34*** | (2006.01) |
| *B65D 43/16* | (2006.01) |

(52) U.S. Cl.
CPC ..... *B65D 81/3823* (2013.01); *B65D 85/34* (2013.01); *B65D 43/164* (2013.01); *B65D 43/165* (2013.01); *B65D 2543/00194* (2013.01)

(58) Field of Classification Search
USPC ..... 206/386–600
See application file for complete search history.

(56) References Cited

U.S. PATENT DOCUMENTS

| | | | | |
|---|---|---|---|---|
| 5,622,276 | A | 4/1997 | Simmons | |
| 2004/0200833 | A1* | 10/2004 | Dubois | B65D 19/18 220/6 |
| 2020/0270022 | A1* | 8/2020 | Yoshida | B65D 43/163 |

FOREIGN PATENT DOCUMENTS

| | | | | | |
|---|---|---|---|---|---|
| CN | 2765864 | | | 3/2006 | |
| CN | 103482228 | | | 1/2014 | |
| CN | 206502216 | | | 9/2017 | |
| CN | 207450527 | | | 6/2018 | |
| CN | 207450527 | U | * | 6/2018 | |
| CN | 108792147 | A | | 11/2018 | |
| CN | 110217462 | A | | 9/2019 | |
| EP | 0071467 | A2 | * | 2/1983 | B65D 11/1873 |
| JP | H0789540 | A | | 4/1995 | |
| JP | 2001160169 | | | 6/2001 | |
| JP | 2002240867 | | | 8/2002 | |
| JP | 2007099369 | A | * | 4/2007 | |
| JP | 2018115022 | A | | 7/2018 | |
| WO | 2019009247 | | | 1/2019 | |
| WO | 2019074101 | A1 | | 4/2019 | |

OTHER PUBLICATIONS

The extended European search report issued in European Application No. 20822471.7, dated Jun. 26, 2023.
Office Action issued in Japanese Application No. 2021-573528, dated Feb. 14, 2023, with English translation.
Office Action issued in Japanese corresponding application No. 20210573528, dated Aug. 15, 2023, with English translation.

* cited by examiner

FOLDABLE BOX

CROSS-REFERENCE TO RELATED APPLICATIONS

This application claims the priority of the Chinese application No. 2019105115907, titled "Foldable Box" filed on Jun. 13, 2019, the contents of which are incorporated by reference herein.

TECHNICAL FIELD

The invention relates to a container, in particular to a foldable box.

TECHNICAL BACKGROUND

When the container is used to contain fresh fruits, vegetables and other foods, especially when cold chain transportation is required, the closure of the container is particularly important, because the transportation of fresh food is very susceptible to pollution from the external environment, causing the food to corrode and deteriorate. However, most of the existing containers are generally containers without lids. When fresh food is loaded into the container, and the top of the container is generally open, so that the food is easily affected by external conditions. However, the existing containers with lids cannot be folded, which renders storage and transportation extremely inconvenient.

Another type of container used to load foods such as fresh fruits and vegetables is an incubator. Existing incubators are mainly a combination of a lid and a non-foldable box. In this form of incubator, the lid and the box are formed with cavities in the thickness of the container sidewall through blister molding, blow molding, or rotational molding. The incubator solution is further formed by leaving holes in the main body and filling the holes with insulation materials. The main problems are as follows:

First, the main body of the container formed by the process of blister molding, blow molding and rotational molding is generally non-foldable (because the gap between the side panels when folded cannot be solved, and the energy exchange between the inside and outside of the incubator through the gap cannot be prevented). Therefore, the non-foldable box occupies a lot of space during the recycling process, and for the distribution industry, it will cause high recycling costs. Further, the container body formed by blister molding, blow molding, or rotational molding processes has a single molding process and corresponding product structure requirements. Compared with conventional injection molds which can form hinge structure and engaging structure (corresponding to incline ejection, puncture of the mold), it is difficult to realize from the blister molding, blow molding, and rotomolding processes (process-limited structure). Therefore, the main body of the incubator formed by the blister molding, blow molding, and rotational molding processes is lack of stable occlusion or hinge structure, which in turn renders low reliability, short service life, and high maintenance cost during transportation.

Second, the cavities inside the side wall thickness of the container formed by blister molding, blow molding, and rotational molding is filled with thermal insulation material (usually polyurethane foam). The main body of the container is generally made of engineering plastic, which has water absorbability and air permeability. The foaming agent in polyurethane will continuously be replaced with the air or moisture in the environment due to the diffusion effect (the cold chain transportation in which the incubator is used has a large difference in humidity and temperature, and the replacement rate is higher), causing the thermal conductivity to gradually increase over time, and finally the insulation effect is reduced. Moreover, the incubator is repeatedly used in the cold chain transportation, and the polyurethane foam has also become a carrier of bacterial growth, and there are also potential safety and health risks. Secondly, as the most widely used insulation material, polyurethane foam is commonly used for chemical foaming (adding a chemical foaming agent (or gas) to the molten plastic). The gas released by the foaming agent when heated includes carbon dioxide, nitrogen, and ammonia. The entire polyurethane foam industry chain is a process that causes pollution to the environment. In addition, the degrading or cracking process of the polyurethane foam is complicated, and the existing process is incineration, which produces a large amount of toxic gas and causes great environmental pollution.

Therefore, there is a need in the art for a foldable container with a lid, which can ensure a relatively closed state in an unfolded and upright state, and can be easily folded and stored when it is not in use.

SUMMARY

The object of the present invention is to provide a foldable container, which is provided with a single articulated lid, which can be folded and stored in the base protruding edge when it is not in use, and preferably can ensure that the container is relatively closed in an unfolded state.

In order to achieve the above object, the present invention provides a foldable box, the foldable box has a box body and a lid, wherein the box body has a base and a pair of opposing first side panels and a pair of opposing second side panels foldably connected to the base, one edge of the lid being operatively connected to the top end of the box body, wherein at least one of the first side panel, the second side panel and the lid is formed by an inner plate and an outer plate connected with each other, and a thermal insulation layer being provided between the inner plate and the outer plate.

In one embodiment, each of the first side panel, the second side panel and the lid is formed by an inner plate and an outer plate connected with each other.

In one embodiment, an edge of the lid is hinged to the top of the box body.

In one embodiment, the base has a plate-shaped body and protruding edges extending upwardly from the periphery of the plate-shaped body, and oth the plate-shaped body and the protruding edges are provided with the thermal insulation layer.

In one embodiment, the inner plate and the outer plate are welded to each other.

In one embodiment, at least one welding rib is provided on the inner side of the outer peripheral edge of one of the inner plate and the outer plate.

In one embodiment, the inner side of the outer peripheral edge of one of the inner plate and the outer plate is provided with two welding ribs spaced apart from each other.

In one embodiment, a cavity for accommodating the thermal insulation layer is formed between a surface of the inner plate and a surface of the outer plate, and the surfaces of the inner plate and the outer plate facing and delimiting the cavity are flat surfaces or the surfaces of the inner plate and the outer plate facing the cavity and delimiting the cavity are provided with at least one reinforcing rib.

In one embodiment, a cavity for accommodating the themal insulation layer is formed between a surface of the inner plate and a surface of the outer plate, and the surfaces of the inner plate and the outer plate facing the cavity and delimiting the cavity are provided with at least one reinforcing rib, wherein the at least one reinforcing ribs are spaced apart from each other and are spaced apart from the welding rib.

In one embodiment, at least one welding rib is provided on the inner side of the outer peripheral edge of one of the inner plate and the outer plate, and the reinforcing ribs are parallel to the welding rib.

In one embodiment, a cavity for accommodating the thermal insulation layer is formed between the surface of the inner plate and the surface of the outer plate, and the surfaces of the inner plate and the outer plate of the second side panel facing and delimiting the cavity are flat surfaces, or the surfaces of the inner plate and the outer plate of the lid and the first side panel facing and delimiting the cavity are provided with at least one reinforcing rib.

In one embodiment, a cavity for accommodating an insulation layer is formed between the surface of the inner plate and the surface of the outer plate, and the surfaces of inner plate and the outer plate facing and delimiting the cavity are provided with at least one reinforcing rib, wherein the at least one reinforcing rib is spaced apart from each other and are spaced apart from the welding rib.

In one embodiment, at least one welding rib is provided on the inner side of the outer periphery of one of the inner plate and the outer plate, and the reinforcing ribs are parallel to the welding rib.

In one embodiment, the outer plate at a pair of opposite edges of the lid extends beyond the edge of the inner plate, one edge of the other pair of opposite edges is provided with a hinge part of the lid, and the outer plate and the inner plate at the other edge are flush with or extend beyond the edge of the inner plate.

In one embodiment, the lid is hinged to one of the pair of opposing first side panels, and the inside of the top end of the other one of the pair of opposing first side panels is provided with an groove facing upward and toward the interior of the box body; alternatively, the inside of the top end of the other of the pair of opposing first side panels is provided with a groove facing upward, and the other edge of the lid opposite to the edge provided with the lid hinge part is provided with a snapping edge, and the snapping edge is operatively snapped into the groove.

In one embodiment, the tops of the first side panel and the second side panel are provided with closed cavities.

In one embodiment, both the left and right ends of the first side panel and the second side panel are provided with side panel engaging portions, and the bottom ends of the first side panel and the second side panel are provided with hinge protruding parts, wherein the side panel engaging parts and the hinge protruding parts are integrally formed on the side panel.

In one embodiment, the side panel engaging parts and the hinge protruding parts are integrally formed on the side panel.

In one embodiment, the base is formed by welding the base body and the bottom plate to each other.

In one embodiment, the base body is provided with a plate-shaped main body cavity and two pairs of opposite protruding ege cavities, wherein the plate-shaped main body cavity and the protruding edge cavities are spaced apart from each other.

In an embodiment, the protruding edge is provided with a plurality of pockets spaced apart from each other and facing upward and toward the interior of the box body, and a thermal insulation layer is provided between the pockets inside of the protruding edge.

In one embodiment, the first edge of the lid is hinged to the top end of one of the pair of first side panels by a hinge, and the first edge of the lid is provided with a hinge part of the lid, and a side panel hinge part is provided on the top end of one of the first side panels, wherein the first edge and the second edge of the hinge part are respectively provided with a first main body hinge portion and a second main body hinge portion, the lid hinge part and the first main body hinge part are hinged to each other, and the side panel hinge part and the second main body hinge part are hinged to each other, wherein a hinge sealing element is connected to the lower side of the hinge, the first side edge of the hinge sealing element operatively abuts against the first side panel.

In one embodiment, at least a part of the second side of the hinge sealing element opposite to the first side overlaps with the sealing element on the lid.

In one embodiment, the second side panel has a plate-shaped main body and a plurality of hinge extension portions extending from the lower part of the plate-shaped main body and spaced apart from each other, and the bottom end of each hinge extension portion is provided with a side panel hinge part, the left and right side edges of the plate-shaped main body and the side panel hinge part are provided with sealing elements.

In one embodiment, each hinge part of the side panel is provided with a separate sealing element.

In one embodiment, the left and right side edges of the plate-shaped body of the second side panel are both provided with side panel engaging parts, and the side panel engaging parts are connected with side panel sealing elements, and the side panel sealing elements extend beyond the side engaging parts.

In one embodiment, the thermal insulation layer is made of plate-shaped material.

In one embodiment, the thermal insulation layer is composed of composite material layers with different functions.

In one embodiment, the first edge of the lid is hinged to the top end of one of the pair of first side panels by a hinge, and the lid is provided with a lid hinged part along the first edge, and a side panel hinged part is provided on the top end of one of the first side panels, wherein the first edge and the second edge of the hinge are respectively provided with a first main body hinged part and a second main body hinged part, the lid hinged part and the first main body hinged part are hinged to each other, and the side panel hinge part and the second main body hinged part are hinged to each other.

In one embodiment, the hinge is a component separate from the box body and the lid, and the lid hinged part is only provided along the first edge of the lid.

In one embodiment, the size of the assembly formed by the hinged connection between the hinge and the lid matches the size of the opening of the foldable box.

In one embodiment, the first main body hinged part of the hinge is provided with a plurality of grooves spaced apart from each other along the first edge, wherein at least one part of the lid hinged part of the lid is located in the groove.

In one embodiment, the widths of the hinge and the lid are set such that when the lid is folded to the outer surface of the side panel, the edge of the lid does not extend beyond the bottom of the side panel.

In one embodiment, the lid has a plate-shaped main body, and the edges of the lid except the first edge are operatively overlapped with the top of the first side panel and the second side panel.

In one embodiment, the lid hinged part includes a plurality of lid extensions that are spaced apart from each other, and each lid extension is provided with a hinging hole; the hinged part of the side panel includes a plurality of extensions spaced apart from each other, each of the side panel extensions is provided with a hinging hole; the first main body hinge portion and the second main body hinged part respectively include a plurality of first main body protruding parts and a plurality of second body protruding parts spaced apart from each other, each of the first main body protruding parts and each of the second main body protruding parts is provided with a hinging hole; wherein the first hinge shaft passes through the hinging holes of the lid protruding parts and the hinging holes of the first main body protruding parts, and the second hinge shaft passes through the hinging holes of the second main body protruding parts and the hinging holes of the side panel protruding parts.

In one embodiment, the lid hinged part includes a plurality of lid protruding parts spaced apart from each other, the side panel hinge includes a plurality of side panel protruding parts spaced apart from each other, and the first main body hinged part and the second main body hinged part respectively include a plurality of first main body protruding parts and a plurality of second main body protruding parts spaced apart from each other; wherein one of the lid protruding parts and the first main body protruding parts is provided with a hinge shaft, and the other is provided with a hinging hole matchable with the hinge shaft; one of the side panel protruding parts and the second main body protruding parts are provided with a hinge shaft, and the other are provided with a hinging hole matchable with hinge shaft.

In one embodiment, one of the two pairs of opposite side panels is a pair of long side panels with longer length, and the other pair of side panels is a pair of short side panels with shorter length, and the lid is hinged to the top of one of the long side panels.

In one embodiment, the base has a plate-shaped main body and a pair of opposing protruding edges extending upward from a pair of opposite edges of the plate-shaped main body, the protruding edge is provided with pockets facing upward and toward the interior of the box body, the two side walls of the each pocket is provided with a first base limiting protrusion at the upper part thereof, and the middle part of the pocket is provided with a base limiting portion integrally extending upwardly from the bottom wall of the pocket and a base guiding portion opening upward and toward the interior of the box body located in the base limiting portion; the bottom end of the long side panel is provided with a plurality of hinge protruding edges spaced apart from each other, and the bottom end of each hinge protruding edge is provided with a side panel hinge shaft and the side panel guiding portion between the side panel hinge shafts; wherein the side panel hinge shaft is matched with the first limiting protrusion and the base limiting portion, and the side panel guiding portion is matched with the base guiding portion.

In one embodiment, the lid is further provided with a locking mechanism for locking the lid to the side panel, and the locking mechanism is provided in the other half part other than the half part where the hinge part of the lid is provided.

In one embodiment, sealing elements are provided between the lid and the first side panels and the second side panels, between the base and the first side panels and the second side panels, and between the first side panels and the second side panels.

In one embodiment, the sealing element between the lid and the first side panels and the second side panels are arranged on the outer periphery of the bottom side of the lid and is fixedly connected to the lid.

In one embodiment, the lid is formed by welding an inner plate and an outer plate, and the outer plate at a pair of opposite edges of the lid extends beyond the edge of the inner plate, and one of the other pair of opposite edges is provided with a lid hinged part, the outer plate and the inner plate at the other edge are flush with each other, and the sealing member on the lid is connected to the inner plate.

In one embodiment, the lid is further arranged such that, in a state where the lid is closed, the part of the outer plate of the lid extending beyond the edge of the inner plate overlaps with the second side panel.

In one embodiment, the sealing element of the lid is a ring-shaped member having two pairs of opposite sides, and the pair of opposite sides of the sealing element of the lid extend beyond the outer edge of the inner plate of the second side panel, and one of the other pair of opposite side edges operatively abuts against the first side panel.

In one embodiment, the lid is hinged to one of the pair of opposed first side panels, and the inside of the top end of the other one of the pair of opposed first side panels is provided with an groove facing upward and toward the interior of the box body, a part of the sealing element of the lid operatively abuts against the groove.

In one embodiment, the sealing element of the lid has a sealing body and at least one row of mounting posts protruding from the sealing body, the ends of the mounting posts are provided with buckles respectively, and the lid has corresponding mounting holes, and the buckles can be buckled into the mounting holes.

In one embodiment, the first edge of the lid is hinged to the top end of one of the pair of first side panels through a hinge, and the first edge of the lid is provided with a lid hinged part, and a side panel hinged part is provided on the top end of one of the first side panels, wherein the first edge and the second edge of the hinge part are respectively provided with a first main body hinged part and a second main body hinged part the lid hinged part and the first main body hinged part are hinged to each other, and the side panel hinged part and the second main body hinged part are hinged to each other, wherein a hinge sealing element is connected to the lower side of the hinge, the first side edge of the hinge sealing element operatively abuts against the first side panel.

In one embodiment, the second side of the hinge sealing element opposite to the first side overlaps with the sealing element on the lid.

In one embodiment, the left and right side edges of the plate-shaped body of the second side panel are both provided with side panel engaging parts, and the side panel engaging parts are connected with side panel sealing elements, and the side panel sealing elements extend beyond the side panel engaging parts.

In one embodiment, the side panel sealing element has a elongated plate-shaped body, a plurality of protrusions spaced apart from each other are provided on the elongated plate-shaped body, and the side panel engaging portion is provided with corresponding recesses, and protrusions on the elongated plate-shaped body are operatively fixed to the recesses.

In one embodiment, the first side panel and the second side panel each have a plate-shaped body and a plurality of hinge protruding parts spaced apart from each other extending from the lower part of the plate-shaped body, and the base has a plate-shaped body and two pairs of opposing protruding edges extending upwardly from two pairs of opposite edges of the plate-shaped body, the protruding edges are provided with a pocket opening upward and toward the interior of the box body, wherein the hinge protruding parts are installed with a sealing element and/or the pocket of the base is equipped with a sealing element.

In one embodiment, the sealing elements installed on the hinge protruding parts are located on the left and right sides and the lower side of the hinge protruding parts and extend beyond the left and right sides and the lower side of the hinge protruding parts.

In one embodiment, the left and right side edges of the plate-shaped main body of the second side panel are equipped with sealing elements.

In one embodiment, each of the hinge protruding parts is connected with a separate sealing element.

In one embodiment, the base has a plate-shaped main body and a pair of opposing protruding edges extending upwardly from a pair of opposite edges of the plate-shaped main body, and the protruding edges are provided with a pocket opening upward and toward the interior of the box body, the middle part of the pocket is provided with a base limiting part integrally extending upwardly from the bottom wall of the pocket; the first side panel and the second side panel both have a plate-shaped main body and a plurality of hinge protruding parts spaced apart from each other extending from the lower part of the plate-shaped main body, the left and right side edges of the plate-shaped main body of the first side panel and/or the second side panel are installed with sealing elements, and the bottom end of each hinge protruding part is provided with a side panel hinge shaft, wherein the side panel hinge shaft is matched with the base limiting part, and the sealing elements installed on the hinge protruding part are located on the left and right sides and lower side of the hinge protruding part and extend beyond the left and right sides and the lower side of the hinge protruding part.

In one embodiment, the left and right edges of the sealing elements installed on the hinge protruding parts are provided with vertical grooves and/or the lower edge is provided with transverse grooves.

In one embodiment, the protruding edge is further provided with a base guiding portion located in the base limiting portion and opening toward the interior, and each of the hinge protruding parts is further provided with a side panel guiding portion located between the hinge shafts of the side panels which is connected to the base guiding portion slidably up and down.

In one embodiment, the base limiting portion is a plate-shaped portion, the base guiding portion is a groove provided in the middle of the base limiting portion, and the upper part of both side walls of the pocket is provided with the first base limiting protrusion.

In one embodiment, the hinge protruding part has a plate-shaped body, and the side panel hinge shaft extends from the left and right sides of the bottom end of the plate-shaped main body in a direction parallel to the side panel, and the side panel guiding portion is guiding block extending from the plate-shaped main body in a direction perpendicular to the plate-shaped body.

In one embodiment, each of the first side panel, the second side panel, and the lid is formed by welding an inner plate and an outer plate, and a thermal insulation layer is provided between the inner plate and the outer plate; the base has a plate-shaped body and a protruding edge extending upwardly from the circumference of the plate-shaped body, and both the plate-shaped body and the protruding edge are provided with thermal insulating layers.

The foldable box of the present application not only realizes the foldable function, but also has good thermal insulation performance. Furthermore, the foldable box of the present application achieve the purpose of thermal insulation by connecting the inner and outer plates, forming a cavity filled with the plate-shaped member thermal-insulating material. The advantage thereof is that the cavity can be filled in non-foaming injection method, so the filling material can be selected in a wider scope flexibly. Compared with polyurethane foaming, the present invention can use composite materials, which can be used to set different functional layers for the main energy transfer pathways (radiation, conduction and convection) to combine in a single piece of plated-shape insulation material. Through the present invention (combination of inner and outer plates+plate-shaped thermal insulation material), the filling material is not limited by the process, and there is a wider choice of flexibility. Moreover, no pollutants are generated during the production process, and the materials can be recycled again.

EMBODIMENTS

Figure 1:
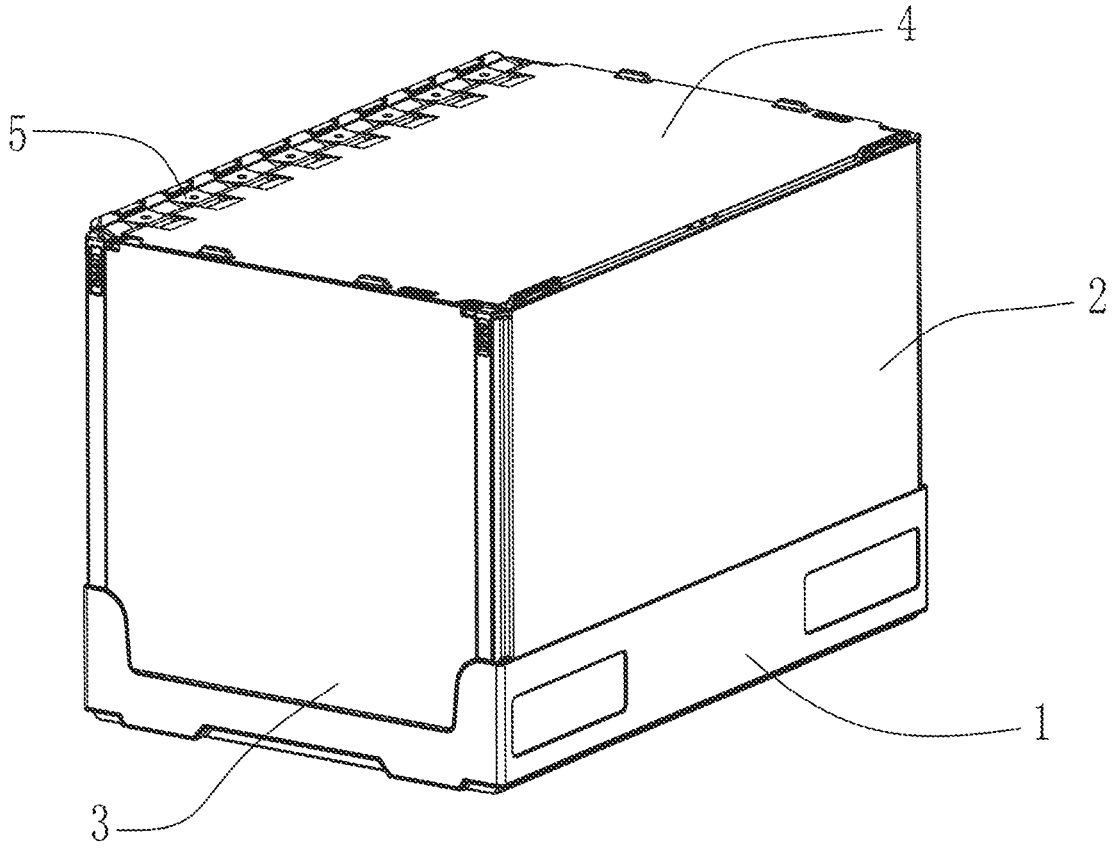
FIG. 1 is a perspective view of a foldable box according to the present invention.

The preferred embodiment of this invention will be described in detail with reference to the accompanying drawings, so that the purposes, the characteristics and the advantages of the invention can be more clearly understood. It should be understood that the embodiments shown in the figures are not intended to limit the scope of this invention, but illustrate the essential spirit of the technical solution of this invention.

In the following description, certain specific details are set forth for purposes of illustrating the various disclosed embodiments to provide a thorough understanding of the various disclosed embodiments. However, those skilled in this art will recognize that embodiments may be practiced without one or more of these specific details. In other instances, well-known devices, structures, and techniques associated with the present application may not be shown or described in detail to avoid unnecessarily obscuring the description of the embodiments.

Unless otherwise desired by context, throughout the specification and claims, the terms "comprising" and variations thereof, such as "containing" and "having", are to be construed as non-exclusive, i.e., to be construed as "comprising, but not limited to".

Throughout the specification "one embodiment" or "one embodiment" means that a particular feature, structure, or characteristic described in connection with the embodiment is included in at least one embodiment. Therefore, the presence of "in one embodiment" or "in one embodiment" at various locations throughout the specification need not all refer to the same embodiment. Additionally, particular features, structures, or features may be combined in any manner in one or more embodiments.

The singular forms "a" and "said" as used in the specification and appended claims include plural references unless the context clearly dictates otherwise. The term "or" be used in its usual sense including "and/or" unless the context clearly dictates otherwise.

In the following description, for clarity of illustration of the structure and mode of operation of the present invention, various directional terms will be used to describe the present invention, but words such as "front", "rear", "left", "right", "outer", "inner", "outward", "inward", "upper", "lower", and the like, should be understood as convenient terms and should not be construed as limiting terms.

Hereinafter, embodiments of the present invention will be described with reference to the drawings. In particular with reference to FIG. 1, a foldable container 100 according to the present invention is shown, which includes a base 1, two pairs of side panels 2, 3, and a lid 4. Each pair of side panels 2 and 3 are hinged to the edge of the base 1 at the bottom end and can be folded relative to the base 1. The lid 4 is hinged to the top end of one of the pair of side panels 2 through a hinge 5. The longitudinal ends of the side panels 2, 3 are respectively provided with engaging portions 202 and 302. When each side panel is erected relative to the base 1, the side panels 2 and 3 are connected by the engaging portions 202 and 302 engaging with each other, thereby forming the internal space of the foldable container 100, the lid 4 can cover the top opening of the foldable box 100. When the side panels 2, 3 and the lid 4 are folded relative to the base 1, the foldable container 100 can be conveniently stored and transported. It should be understood that the connection manner between the side panels 2 and 3 is not limited to the above-mentioned engagement, as long as they can be connected end to end to enclose the internal space. The bottom ends of the side panels 2 and 3 are provided with side panel hinged parts to be hingedly connected to the outer edge of the base 1.

Figure 2:
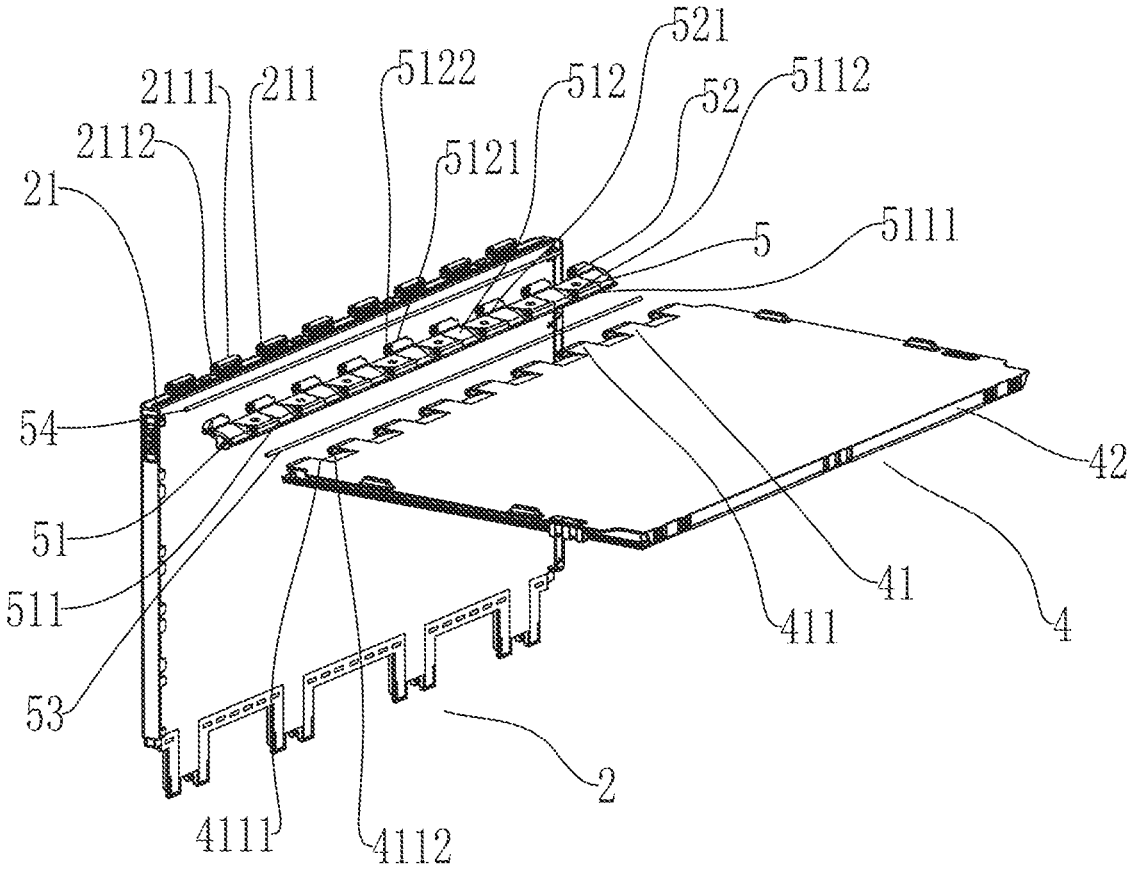
FIG. 2 is an exploded perspective view of the side panels, hinges and lid of the foldable box according to the present invention.

FIG. 2 shows an exploded perspective view of the side panel 2, the hinge 5 and the lid 4 of the foldable box 100. As shown in the figure, the lid 4 is provided with a hinged part 411 along the first edge 41 adjacent to the side panel 2, and the top end 21 of the side panel 2 (also called the long side panel or the first side panel) is provided with side panel hinged part 211. The hinge 5 has a first edge 51 adjacent to the lid 4 and a second edge 52 adjacent to the side panel 2. The first edge 51 and the second edge 52 of the hinge 5 are respectively provided with a first main body hinged part 511 and a second main body hinged part 521. The lid hinged part 411 and the first main body hinged part 511 are hinged to each other, and the side panel hinged part 211 and the second main body hinged part 521 are hinged to each other.

In addition, in order to better close the top opening by the lid 4, it is preferable to provide a groove pocket facing upward and toward the interior of the box body on the inside of the top end of the other of the pair of opposite side panels 2, so as to receive the second edge 42 of the lid 4 in use.

In the illustrated embodiment, said pair of side panels 2 are the long side panels with a longer length of the two pairs of opposite side panels, and the other pair of side panels 3 (also called short side panels or second side panels) is short side panel with a shorter length, the lid 4 is hinged to the top end 21 of one of the long side panels 2. However, it should be understood that the lid 4 can also be hinged to the top end of one of the short side panels 3 through a hinge without departing from the scope of the present invention. In another embodiment, the lid can also be covered on the top of the side panel by means of for example snapping connection.

In the specific embodiment shown in FIG. 2, the lid hinge 411 includes a plurality of lid protruding parts 4111 spaced apart from each other, and each lid protruding part 4111 extends horizontally from the edge 41 of the lid 4 along the plane where the lid 4 is located. Each lid protruding part 4111 is provided with a hinging hole 4112, and the hinging hole 4112 extends substantially along the first edge 41. The side panel hinged part 211 includes a plurality of side panel protruding parts 2111 spaced apart from each other. Each side panel protruding part 2111 extends upwardly from the top end 21 of the side panel 2 along the plane where the side panel 2 is located, and each side panel protruding part 2111 is provided with a hinging hole 2112, and the hinging hole 2112 extends substantially along the top end 21 of the side panel 2. The first main body hinged part 511 and the second main body hinged part 512 respectively include a plurality of first main body protruding parts 5111 and second main body protruding parts 5121 spaced apart from each other, and each first main body protruding part 5111 is provided with a hinging hole 5112, each second main body protruding part 5121 is provided with a hinging hole 5122. The hinging holes 5112 and 5122 extend substantially along the edges 51 and 52 of the hinge 5 respectively. Preferably, the hinging holes 4112 are aligned with each other, and the hinging holes 5112 are also aligned with each other. Therefore, when the lid protruding parts 4111 and the first main body protruding parts 5111 are alternately placed with each other, the hinging holes 4112 and the hinging holes 5112 are also aligned with each other, so that the hinge connection between the hinge 5 and the lid 4 can be realized by passing the first hinge shaft 53 through each hinging hole 4112 and each hinging hole 5112. Preferably, the hinging holes 2112 are aligned with each other, and the hinging holes 5122 are also aligned with each other. Therefore, when the side panel protruding parts 2111 and the second main body protruding parts 5121 are alternately placed with each other, the hinging holes 2112 and the hinging holes 5122 are also aligned with each other, so that the hinge connection between the hinge 5 and the side panel 2 can be realized by passing the second hinge shaft 54 through each hinging hole 2112 and each hinging hole 5122. More preferably, the first edge 51 and the second edge 52 of the hinge 5 are parallel to each other. In this way, after the lid 4 is hinged to the side panel 2 via the hinge 5, the first hinge shaft 53 and the second hinge shaft 54 are parallel to each other.

Preferably, the first main body hinged part 511 of the hinge 5 is provided with a plurality of grooves 512 spaced apart from each other along the first edge 51, and at least one part of the lid hinged part 411 of the lid 4, in particular the lid protruding parts 4111 of the lid hinged part 411 are located in the groove 512. Preferably, when the opening of the foldable container 100 is closed by the lid 4, the lid protrusions 4111 are snugly fitted in grooves 512, so as to further ensure the closure of the opening.

In addition, in an unshown embodiment, it may be provided that one of the lid protruding part 4111 and the first main body protruding part 5111 is provided with a hinge shaft, and the other is provided with a hinging hole for cooperating with the hinge shaft, so that the hinge connection between the lid 4 and the hinge 5 can be achieved by the cooperation of the hinge shaft and the hinging hole. Alternatively or additionally, it may be provided that one of the side panel protruding part 2111 and the second main body protruding part 5121 is provided with a hinge shaft, and the other is provided with a hinging hole for cooperating with the hinge shaft, so that the hinge connection between the side panel 2 and the hinge 5 can be achieved by the cooperation of the hinge shaft and the hinging hole.

Figure 5:
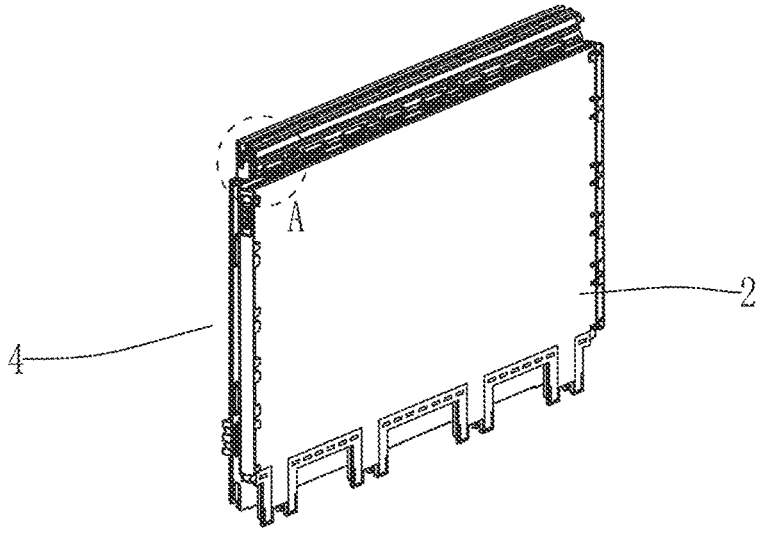
FIG. 5 is a perspective view of the lid folded outward relative to the side panel.
Figure 5A:
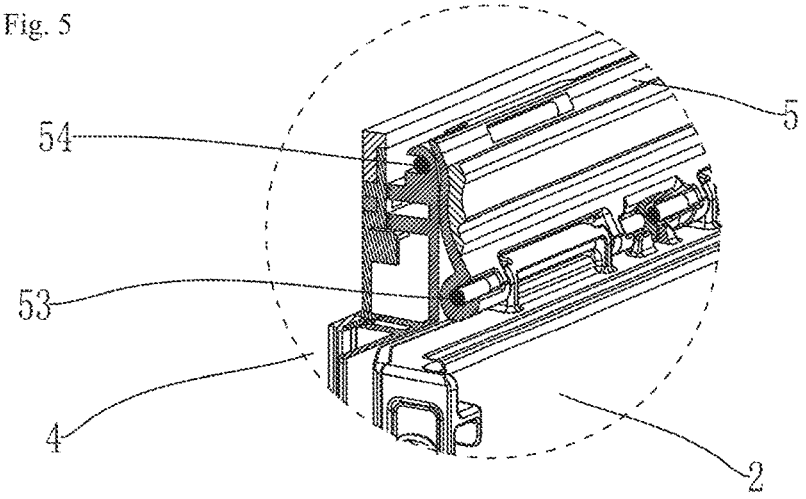
FIG. 5A is an enlarged view of detail A in FIG. 5.

Of course, it should be understood that the hinged connection between the lid 4 and the hinge 5 and the hinged connection between the side panel 2 and the hinge 5 are not limited to the above structures, and other conventional hinge structures in the art may also be used, for example they are hinged through flexible thinned portion without departing from the scope of the present invention. In the present invention, when the lid 4 is hingedly connected with the side panel 2 through the hinge 5, the lid 4 can rotate more than 270° around the top end of the side panel 2 relative to the side panel 2, as shown in FIG. 5. When the foldable box 100 is in use, the lid 4 is perpendicular to the side panel 2 and closes the opening of the foldable box 100. When the foldable box 100 is in the storage state, the lid 4 can be rotated relative to the top end of the side panel 2 to be placed on the outer surface of the side panel 2, so that after the other three side panels are folded and placed on the base 1, the side panel 2 and the lid 4 can be placed on the other three side panels. In this way, the foldable box 100 in the storage state is convenient for storage and transportation.

In the embodiment shown in the figures, the hinge 5 is a component separate from the side panel 2 and the lid 4, and the lid hinged part 411 is only provided on the first edge 41 of the lid 4. However, it should be understood that the hinge 5 can also be integrally formed with one or both of the side panel 2 and the lid 4 without departing from the scope of the present invention. For example, as mentioned above, the hinge 5 may be hingedly connected to the top end 21 of the side panel 2 and/or the first edge 41 of the lid 4 through a flexible thinned portion. Preferably, the thickness of the hinge 5 is equal to the sum of the thickness of the side panel 2 and the lid 4, so that when the lid 4 is folded onto the outer surface of the side panel 2, it can be placed to the outer surface of the side panel 2 flatly without protruding upward.

Figure 3:
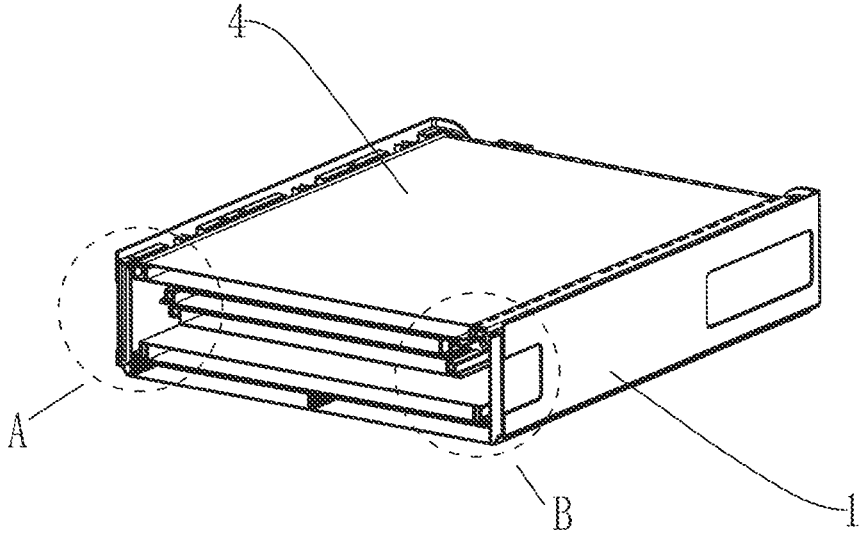
FIG. 3 is a perspective view of a foldable box according to the present invention in the collapsed state.
Figure 3A:
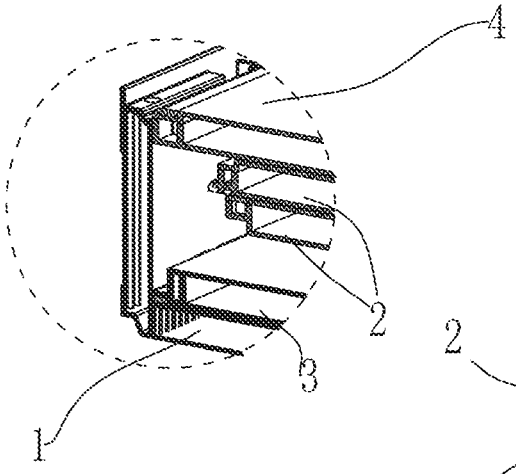
FIG. 3A is an enlarged view of detail A in FIG. 3.
Figure 3B:
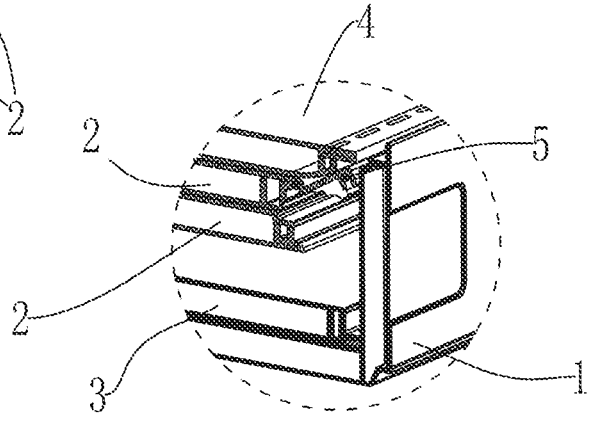
FIG. 3B is an enlarged view of detail B in FIG. 3.

When the foldable box 100 is in use, the size of the assembly formed by hinged connection between the hinge 5 and the lid 4 matches the size of the opening of the foldable box 100, so that the opening of the foldable box 100 can be closed. When the foldable box 100 is in the storage state as shown in FIG. 3, the side panel 2 is folded onto the base 1, and the lid 4 is flipped and folded onto the outside of the side panel 2. At this time, the second edge 42 of lid 4 opposite to the first edge 41 does not extend beyond the bottom end of the side panel 2, so as to ensure that the second edge 42 of the lid 4 does not extend beyond the outer edge of the base 1 in the folded state.

Figure 4:
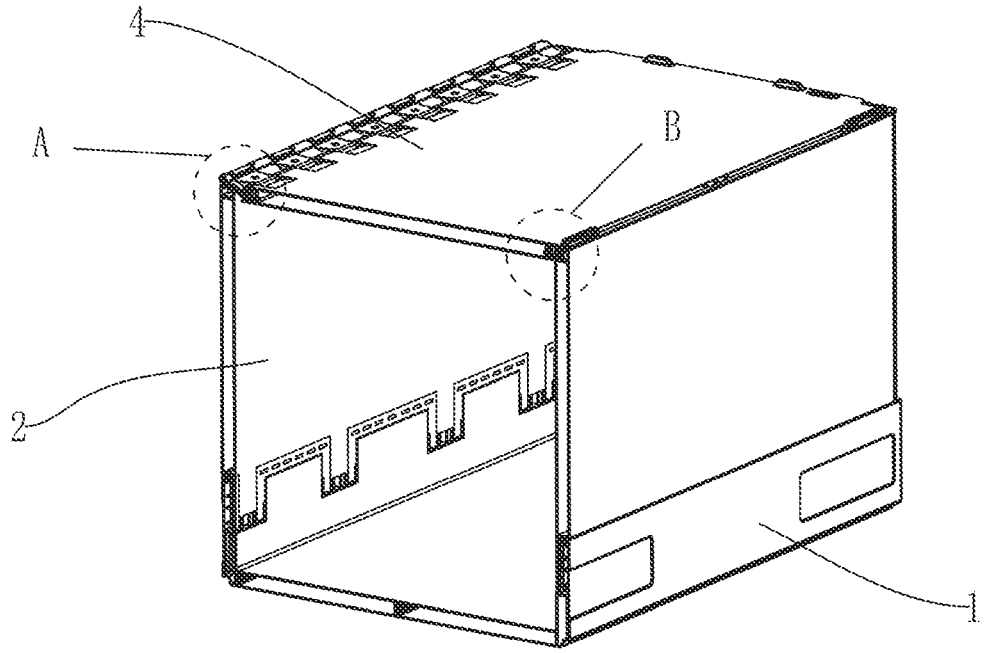
FIG. 4 is a perspective view of a foldable box according to the present invention with a pair of side panels removed.
Figure 4A:
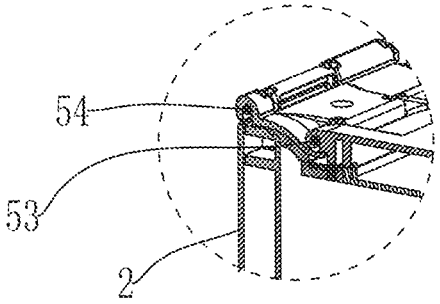
FIG. 4A is an enlarged view of detail A in FIG. 4.

The lid 4 shown in FIG. 2 has a plate-shaped body, and the other three edges of the lid 4 other than the first edge 41 are operatively overlapped on the top ends of the other side panel 2 and the two side panels 3, respectively, as shown in FIG. 4.

Figure 6A:
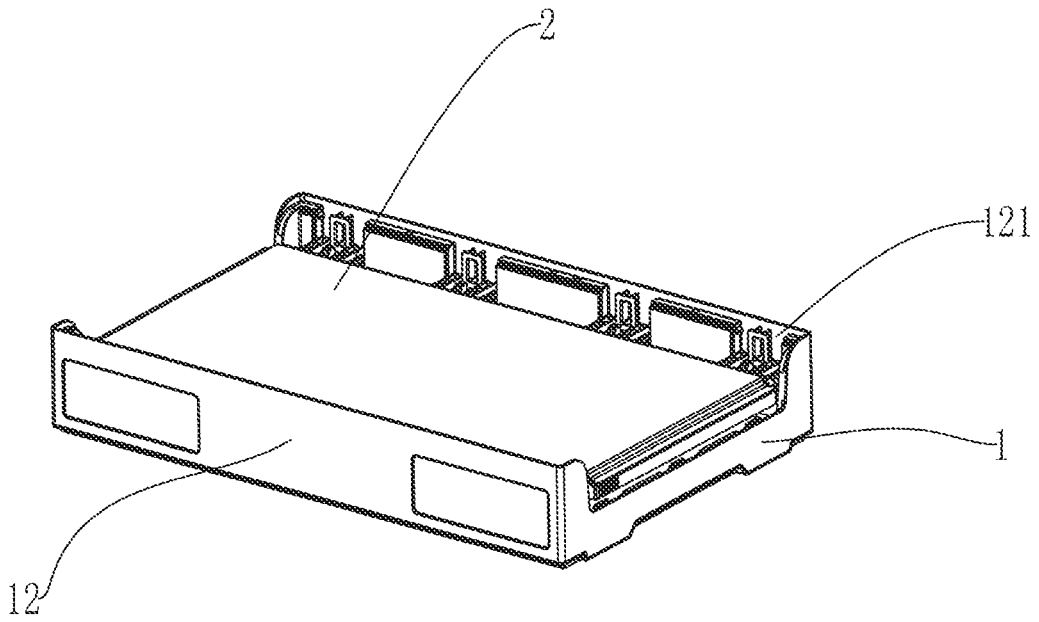
FIG. 6A is a perspective view of a pair of opposed side panels folded relative to the base of the foldable box according to the present invention.
Figure 6B:
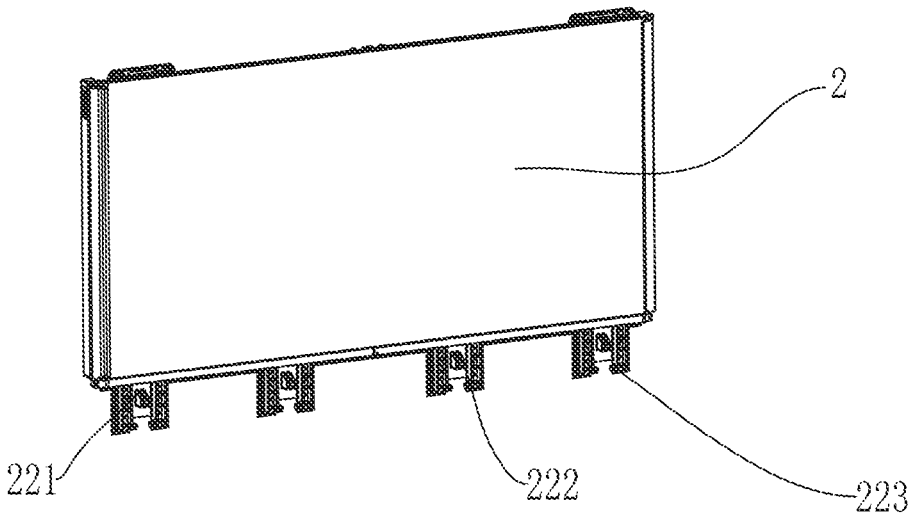
FIG. 6B is a perspective view of the side panel of the foldable box according to the present invention.
Figure 6C:
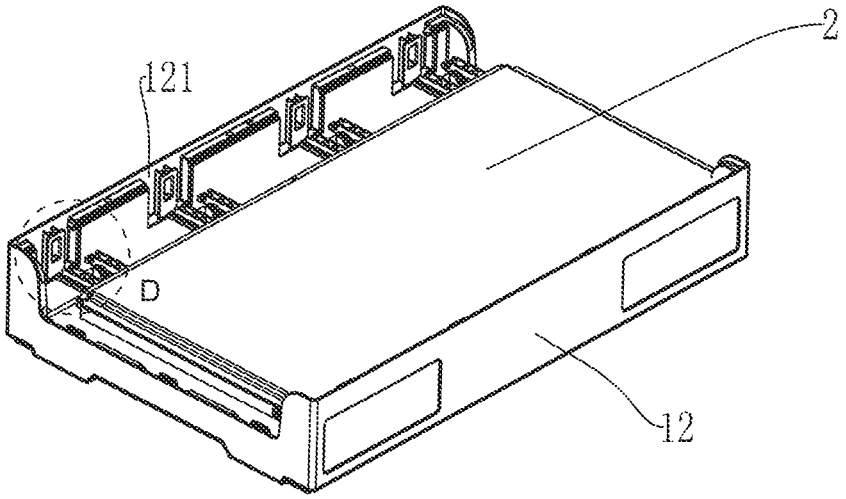
FIG. 6C is a schematic diagram of the side panel detached from the base of the foldable box according to the present invention.
Figure 6D:
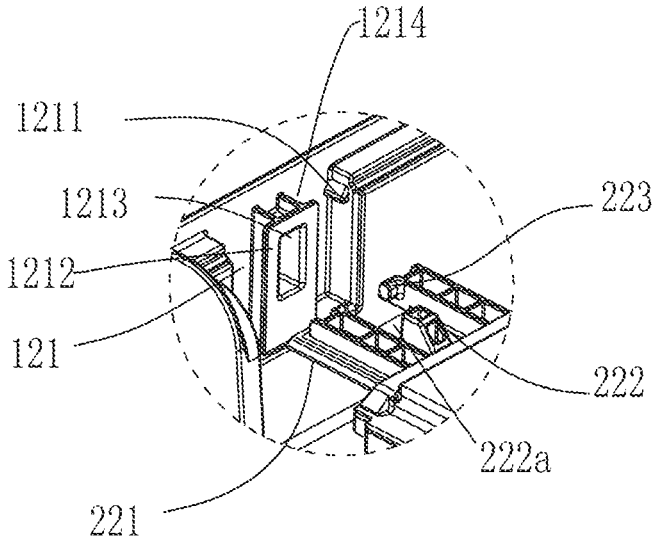
FIG. 6D is an enlarged view of detail D in FIG. 6C.
Figure 7:
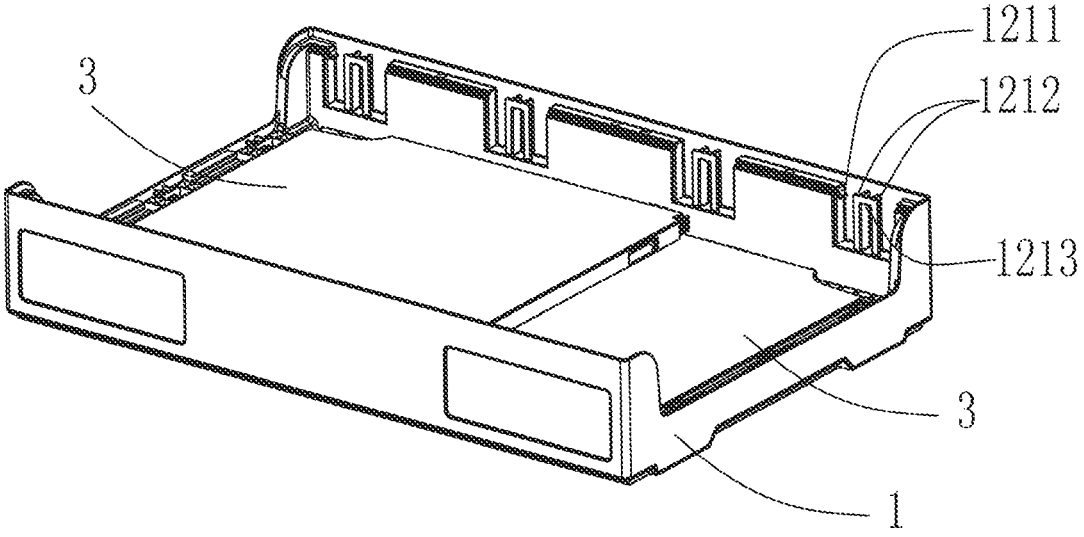
FIG. 7 is a partially exploded perspective view of the foldable box according to the present invention, in which a pair of opposite side panels are folded on the base.
Figure 8:
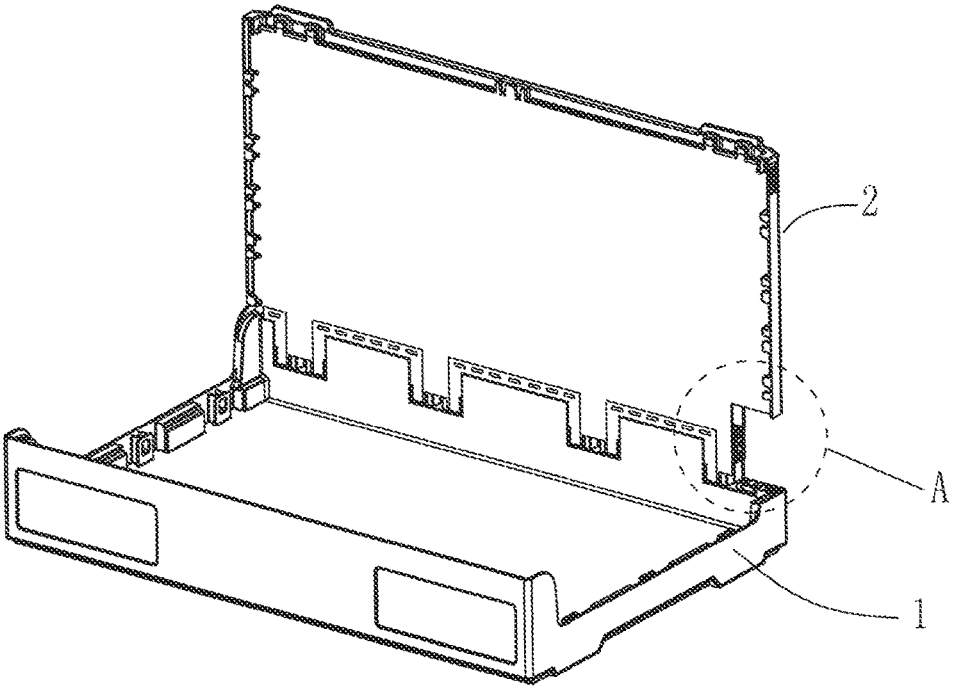
FIG. 8 is a partial cross-sectional view of the side panel in an upright state with respect to the base, in which the hinge part is cut away.

In the foldable box 100 shown in FIG. 1, the base 1 has a plate-shaped main body 11 and a pair of opposite protruding edges 12 extending upwardly from a pair of opposite edges of the plate-shaped main body 11. FIG. 6A shows the foldable box 100 with the side panels 2 in a folded state. FIG. 6C shows a perspective view of the side panel 2 separated from the base 1. FIG. 6D shows a partial enlarged view thereof. As shown in FIG. 6D, the protruding edge 12 is provided with a pocket 121 which opens upward and inward. A first base limiting portion 1211 is provided on the upper portion of two side walls of the pocket 121, and a base limiting portion 1212 integrally extending upwardly from the bottom wall of the pocket 121 and a base guiding portion 1213 in the base limiting portion and opening inwardly are provided in the middle of the pocket 121. The cross section of the base limiting portion 1212 is in a "T" shape, so that two elongated opening grooves 1214 are formed on both sides and the side walls of the pocket 121. The base guiding portion 1213 is a longitudinally extending pocket. The base guiding portion 1213 extends upwardly (longitudinal) by a predetermined distance from a position at a predetermined distance from the base limiting portion. The bottom end of the side panel 2 is provided with a plurality of hinge protruding parts 22 extending downwardly and spaced apart from each other. When the side panel 2 is erected relative to the base 1, the hinge protruding parts 22 are received in the pockets 121. The hinge protruding part 22 includes two side panel limiting portions 221 extending downwardly from the side panel 2, the two side panel limiting portions 221 are provided with side panel hinge shafts 223 on opposite sides thereof, and the side panel hinge shafts 223 can be rotated and slided up and down in the groove 1214 to switch between the erected state and the folded state of the side panel 2 relative to the base 1. A side panel guiding portion 222 is also provided between the two side panel limiting portions 221. The side panel guiding portion 222 has a plate-shaped portion 222*a* connected between the two side panel limiting portions 221 and a guiding block 222*b* extending perpendicular to the plate-shaped portion 222*a*. The guiding portion is slidably connected to the base guiding portion. When the side panel 2 is in an erected state, the guiding block 222*b* is engaged in the base guiding portion 1213 to fix the side panel 2 to the protruding edge 12, as shown in the partial cross-sectional view of FIG. 8 and the partial enlarged view of FIG. 8A. The structure of the base guiding portion 1213 and the structure of the side panel guiding portion 222 are provided such that when the side panel is in the folded state, the connection between the side panel and the base is in a flat state, and there is no depressed portion thereon. When the side panel 2 is in the folded state, the first base limiting protrusion 1211 blocks the side panel limiting portion 221 to prevent the side panel 2 from being separated from the base 1 upwardly. In the figure, four pockets 121 provided on the protruding edge 12 and four hinge protruding parts 22 provided on the bottom end of the side panel 2 are shown, but it should be understood that any suitable number of pockets 121 and hinge protruding parts 22 can be provided.

Preferably, the lid 4 is also provided with a locking mechanism for locking the lid 4 to the side panel, and the locking mechanism is provided on the portion of the lid 4 away from the first edge 41, so that the lid 4 can be closed more firmly to the side panel.

Figure 9:
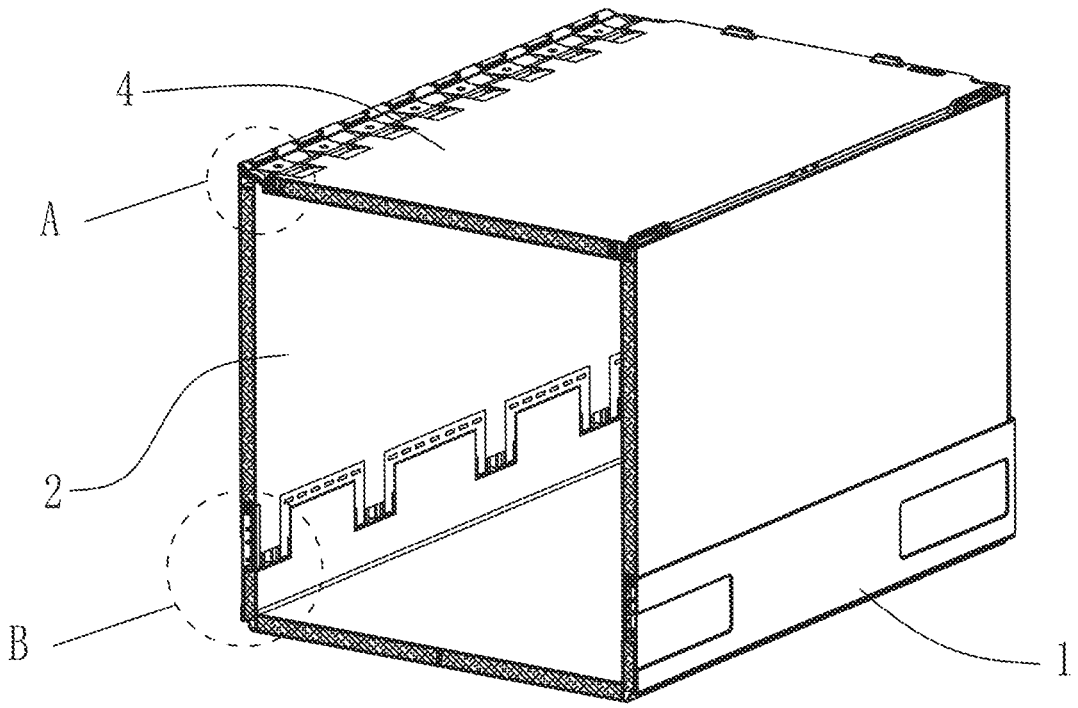
FIG. 9 is a vertical sectional perspective view of a foldable box provided with a thermal insulation layer.
Figure 9A:
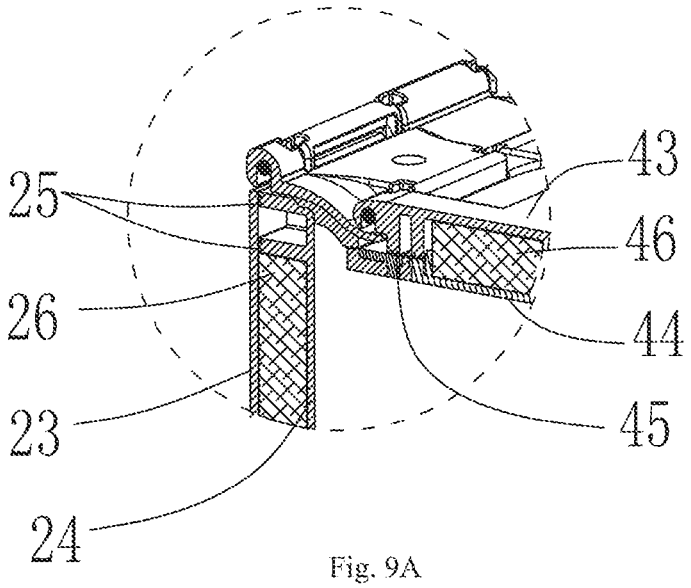
FIGS. 9A and 9B are enlarged views of details A and B of FIG. 9, respectively.
Figure 9B:
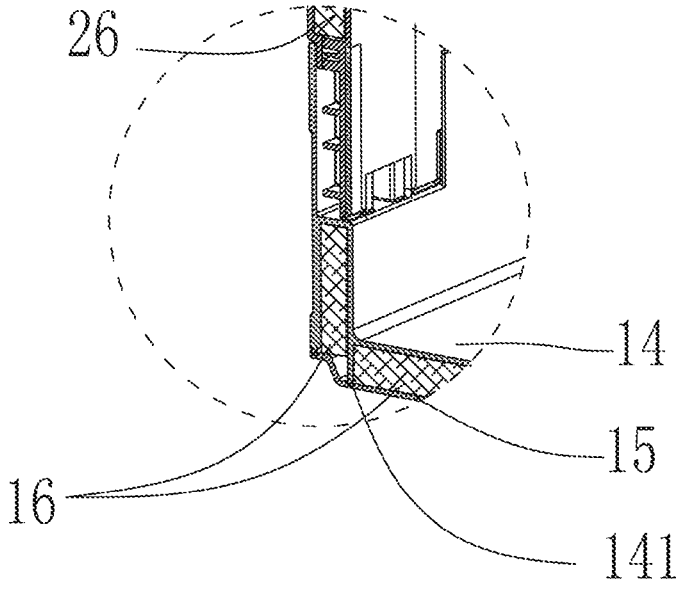
Figure 10:
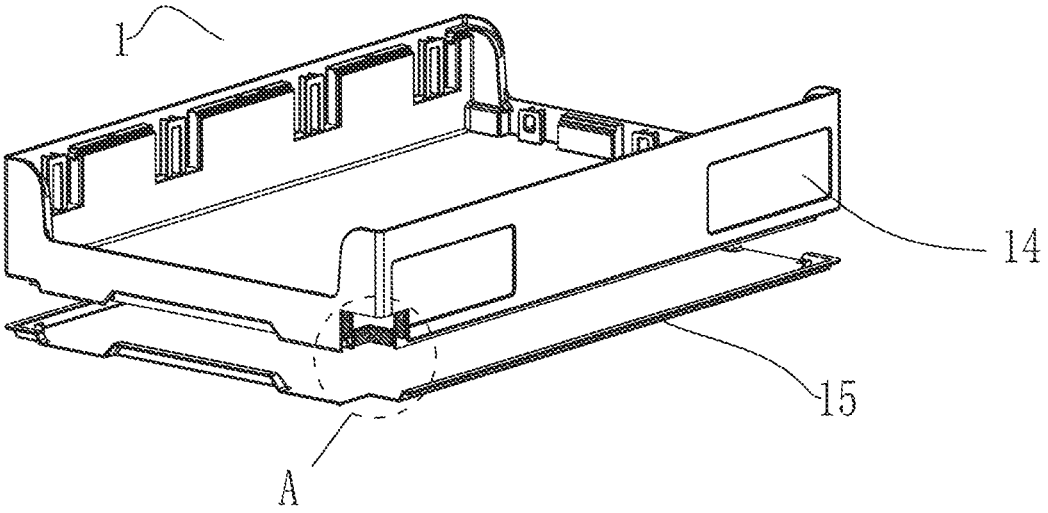
FIG. 10 is a partially cut-away exploded perspective view of the base of the foldable box according to the present invention.
Figure 10A:
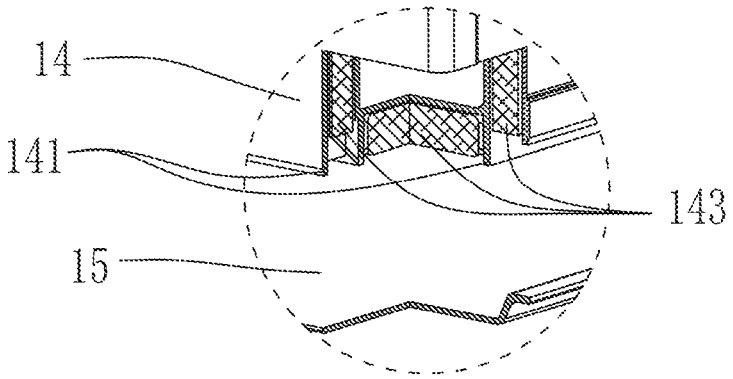
FIG. 10A is an enlarged view of detail A in FIG. 10.
Figure 11:
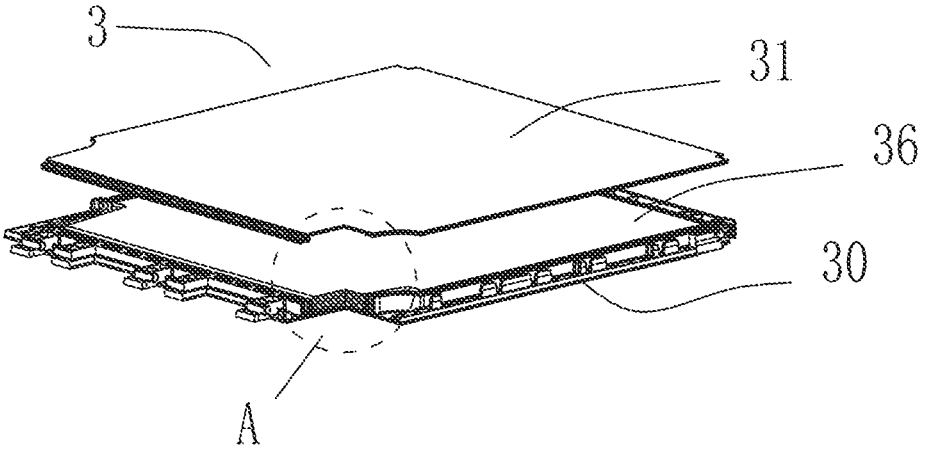
FIG. 11 is a partially cut-away exploded perspective view of the side panel of the foldable box according to the present invention.
Figure 11A:
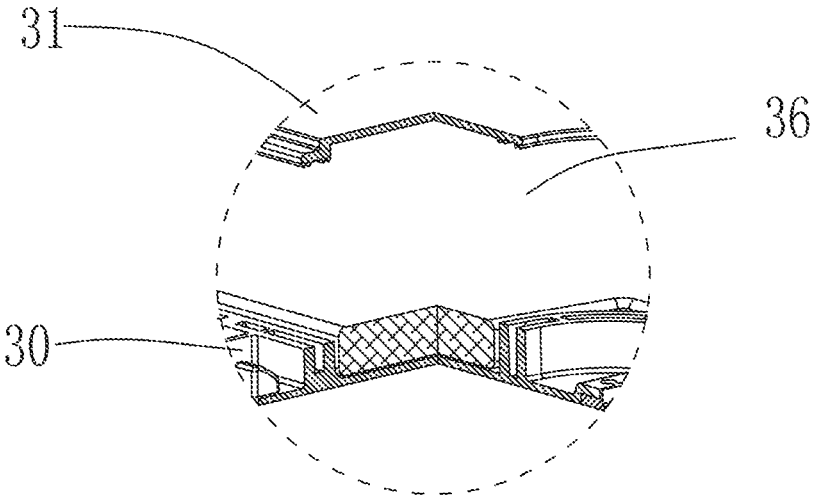
FIG. 11A is an enlarged view of detail A in FIG. 11.

The foldable box 100 of the present invention can also have a thermal insulation function by providing a thermal insulation layer in the base 1, the side panels 2 and 3, and the lid 4. As shown in FIGS. 9, 9A and 9B, each of the first side panel 2, the second side panel 3, and the lid 4 has an inner plate and an outer plate welded to each other, and there is a thermal insulation layer provided between the inner plate and the outer plate. As shown in FIGS. 10 and 10A, the plate-shaped main body 11 and the protruding edge 12 of the base 1 are also provided with a thermal insulation layer 16. The above-mentioned thermal insulation layers can be prefabricated thermal insulation boards and then placed in the base, side panels and the lid. The thermal insulation material can be a composite material. For the main energy transfer manners (radiation, conduction and convection), a plate-shaped thermal insulation material with different functional layers combined therein can be provided. Through the combination of the inner and outer plates and the plate-shaped thermal insulation material of the present invention, the filling material is not limited by the process and can be selected in a wider range flexibility. Moreover, no pollutants are generated during the production process, and the materials can be recycled again. In one embodiment, the lid and the side panel can be combined with a vacuum plate and a thermal radiation reflective film, which can block thermal radiation, convection and conduction, thereby achieving the purpose of thermal insulation. Further, the above-mentioned inner plate and outer plate may be connected to each other by welding, or may be connected to each other by other means such as screws.

The detailed enlarged view of FIG. 9A shows the internal structure at the top end 21 of the side panel 2 and the internal structure at the first edge 41 of the lid 4. The side panel 2 is formed by welding the side panel outer plate 23 and the side panel inner plate 24 to each other, and the lid 4 is formed by welding the lid outer plate 43 and the lid inner plate 44 to each other. The inner side of the side panel inner plate 24 is provided with welding ribs 25 on the inner side of the outer peripheral edge. The welding ribs 25 extend substantially along the outer peripheral edge of the side panel inner plate 24 and extend from the outer surface of the side panel inner plate 24 toward the inner surface of the side panel outer plate 23, and are used to weld at the end to the inner surface of the side panel outer plate 23. However, it should be understood that the welding ribs 25 may also be arranged inside the outer peripheral edge of the side panel outer plate 23 and extend from the inner surface of the side panel outer plate 23 toward the outer surface of the side panel inner plate 24 and used for welding at the end to the outer surface of the side panel inner plate 24. It should also be understood that welding ribs 25 can be provided on both the inner side of the outer peripheral edge of the side panel outer plate 23 and the inner side of the outer peripheral edge of the side panel inner plate 24, and the ends of the welding ribs 25 are welded to each other. Preferably, as shown in the figure, the side panel 2 is provided with two welding ribs 25 parallel to each other and spaced apart from each other. When the side panel 2 and the lid 4 of the foldable box 100 are made of plastic materials, the welding between the welding rib 25 and the outer surface of the side panel inner plate 24, the inner surface of the side panel outer plate 23 or another welding rib 25 is realized by ultrasonic welding to improve the sealability of the welding lines. In the internal space enclosed by the side panel inner plate 23, the side panel outer plate 24 and the welding ribs 25, an thermal insulation layer 26 is provided. The arrangement of the two spaced apart welding ribs 25 can further ensure the sealability of the space enclosed by the outer plate, the inner plate and the welding ribs relative to the outside. In addition, in order to facilitate manufacturing, preferably, the aforementioned side panel engaging portion and side panel hinged part are integrally formed on the side panel outer plate 23.

The surface of the inner plate, the surface of the outer plate and the welding ribs form a cavity for accommodating the thermal insulation layer, the surfaces of the inner plate and the outer plate facing the cavity and delimiting the cavity are flat surfaces or is provided with at least one reinforcing rib. When the reinforcing ribs are arranged, the reinforcing ribs are spaced apart from each other and from the welding ribs. Preferably, the reinforcing rib is parallel to the welding rib. In an embodiment, the surfaces of the inner plate and the outer plate of the second side panel facing the cavity and delimiting the cavity are flat surfaces. In another embodiment, the surface of the lid and the inner and outer plates of the first side panel facing the cavity and delimiting the cavity is provided with at least one reinforcing rib.

The side panel 3 can also be formed by welding the outer plate 30 and the inner plate 31, with an insulating layer 36 filled between. The specific structure is the same as that of the side panel 2, and will not be repeated here.

When two welding ribs 25 are provided, the top of the side panel 2 is provided with a closed cavity, which is formed by the two welding ribs 25 and the side panel inner plate 24 and the side panel outer plate 23 together As also shown in FIG. 9A, the outer periphery of the lid outer plate 43 is provided with welding ribs 45, which extend substantially in the direction of the outer periphery of the lid outer plate 43 and extend from the inner surface of the lid outer plate 43 toward the outer surface of the lid inner plate 44, and is used to be welded at the end to the outer surface of the lid inner plate 44 thereof. However, it should be understood that the welding ribs 45 can also be arranged inside the outer periphery of the lid inner plate 44 and extend from the outer surface of the lid inner plate 44 toward the inner surface of the lid outer plate 43 and are used for welding at the end to the outer surface of the lid outer plate 43 thereof. It should also be understood that welding ribs 45 can be provided on the inner side of the outer periphery edge of the lid outer plate 23 and the inner side of the outer periphery edge of the lid inner plate 44, and the ends of the welding ribs 45 are welded to each other. Preferably, as shown in the FIG. 9A, the lid 4 is provided with two welding ribs 45 parallel to each other and spaced apart from each other. In the case that the lid 4 of the foldable box 100 is made of plastic material, the welding between the welding rib 25 and the outer surface of the lid inner plate 44, the inner surface of the lid outer plate 43 or another welding rib 45 is performed by ultrasonic welding so as to improve the sealability of the welding lines. In the internal space enclosed by the lid outer plate 43, the lid inner plate 44 and the welding ribs 45, a thermal insulation layer 46 is provided. The arrangement of the two spaced apart welding ribs 45 can further ensure the sealability of the space enclosed by the outer plate, the inner plate and the welding ribs with respect to the atmosphere.

Figure 4B:
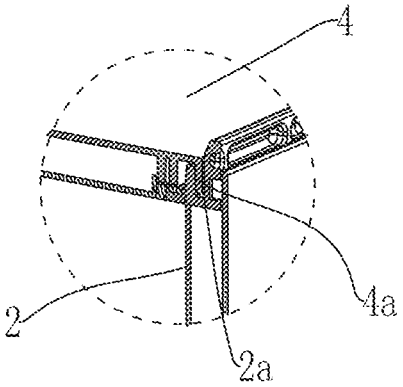
FIG. 4B is an enlarged view of detail B in FIG. 4.
Figure 12:
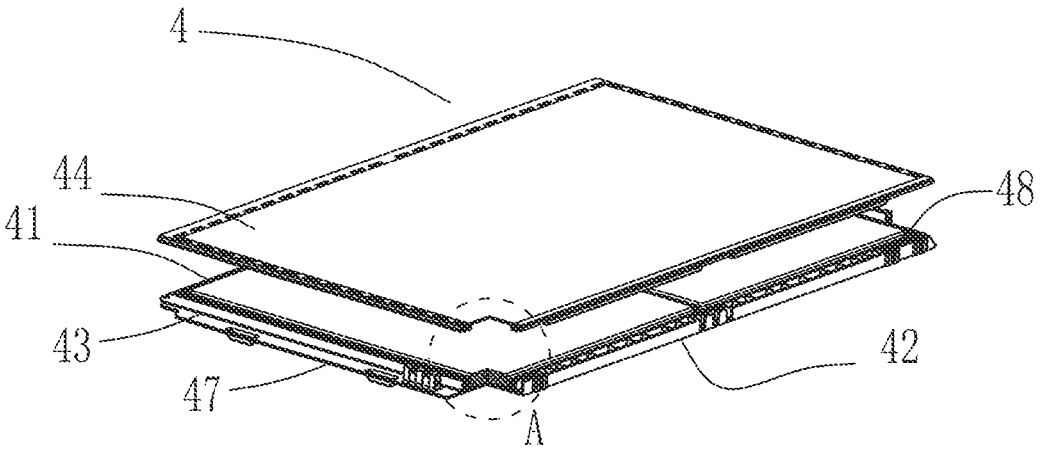
FIG. 12 is a partially cut-away exploded perspective view of the lid of the foldable box according to the present invention.
Figure 12A:
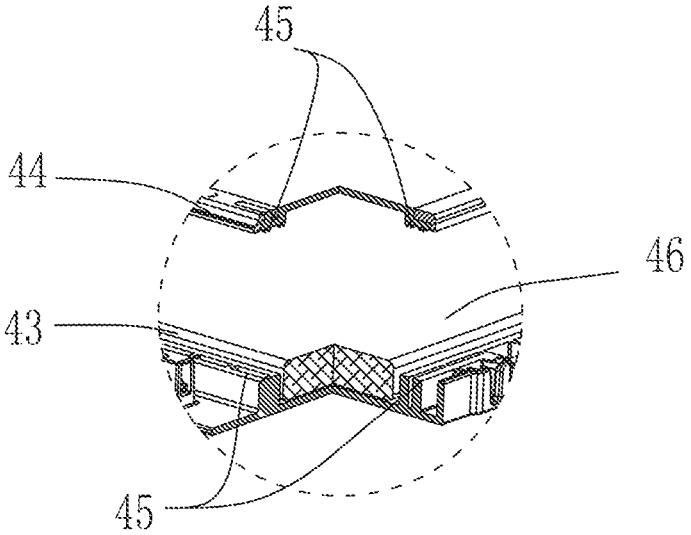
FIG. 12A is an enlarged view of detail A in FIG. 12.
Figure 13:
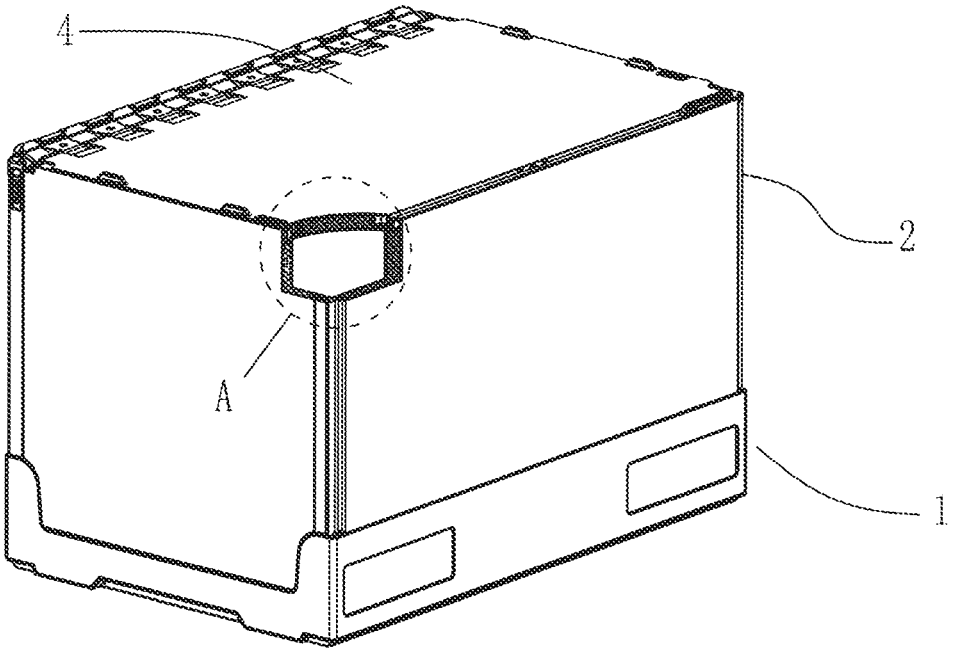
FIG. 13 is a partially cut-away perspective view of the foldable box according to the present invention, in which the intersection of the side panels and the lid is cut away.
Figure 13A:
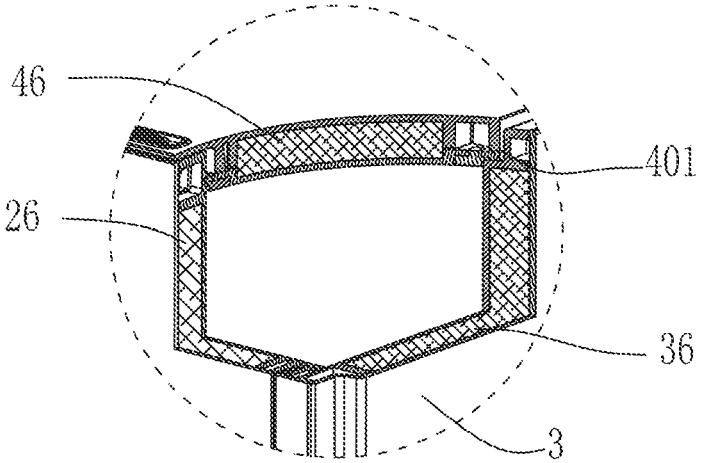
FIG. 13A is an enlarged view of detail A in FIG. 13.

FIG. 12 shows a bottom exploded perspective view of the lid 4. The lid 4 has four edges 41, 42, 47, and 48. Preferably, the first edge 41 is provided with lid hinged parts 4111, and the lid outer plate 43 at the second edge 42 extends beyond the lid inner plate 44 and overlaps with the inner side of the side panel 2 when the lid is closed. Specifically, as shown in FIG. 4B, the edge of the lid outer plate 43 may be provided with a snapping edge 4*a*, and the top end of the inner side of the side panel 2 is provided with a groove 2*a* opening upwardly, and the snapping edge 4*a* can be clamped into the groove 2*a*. In another embodiment, the outer plate is flush with the inner plate at the second edge 42. At the other two edges 47 and 48, the lid outer plate 43 extends beyond the lid inner plate 44. Preferably, when the foldable box 100 is in use, the part of the lid outer panel 43 that extends beyond the lid inner panel 44 is overlapped on the side panel 3.

FIG. 9B shows a cross-sectional view of the protruding edge 12 of the base 1. FIGS. 10 and 10A show an exploded view of the base 1 and the detailed enlarged view thereof. It can be seen from the figure that the base 1 is formed by welding the base body 14 and the base bottom plate 15 to each other. The base body 14 is provided with a plate-shaped main body cavity 142 that opens downwards and two pairs of opposite protruding edge cavities 143; and the plate-shaped main body cavity 142 and the protruding edge cavity 143 are separated from each other by a base welding rib 141. The base body 14 includes a base plate 145 which is rectangular. The protruding edge 12 is formed by a protruding edge inner plate 124 and a protruding edge outer plate 123. The protruding edge inner plate 124 and the protruding edge outer plate 123 respectively form the inner surface and outer surface of the protruding edge 12. The protruding edge inner plate 124 extends upward from the edge of the protruding edge substrate 145, and the base welding rib 141 extends downward from the edge of the protruding edge substrate 145 and is used for welding to the upper surface of the base bottom plate 15. The lower end of the protruding edge outer plate 123 is also welded to the upper surface of the base bottom plate 15, preferably to the edge of the upper surface of the base bottom plate 15. The protruding edge inner plate 124 and the protruding edge outer plate 123 and the base welding ribs 141 jointly form a protruding edge cavity 143, and the base substrate 145 and the base welding ribs 141 jointly form a plate-shaped main body cavity 142. Insulation layers are respectively arranged in the protruding edge cavity 143 and the plate-shaped main body cavity 142. In addition, as described above, the protruding edge 12 is further provided with a plurality of pockets 121, and the part of the protruding edge 12 located between the pockets 121 is also provided with a thermal insulation layer. The thermal insulation layer is usually made of lightweight foam.

The foldable box 100 adopting the above structure has good thermal insulation performance and can be used for storing fresh products.

According to the present invention, in order to achieve better sealability and thermal insulation, a sealing structure can also be provided to the foldable box 100. Specifically, as shown in FIGS. 14-22A, in the foldable box 100, sealing elements are provided between the lid 4 and the side panels 2 and 3, between the base 1 and the side panels 2 and 3, and between the side panel 2 and the side panel 3, so as to realize the sealing of the inside of the foldable box 100 relative to the atmosphere.

Figure 19:
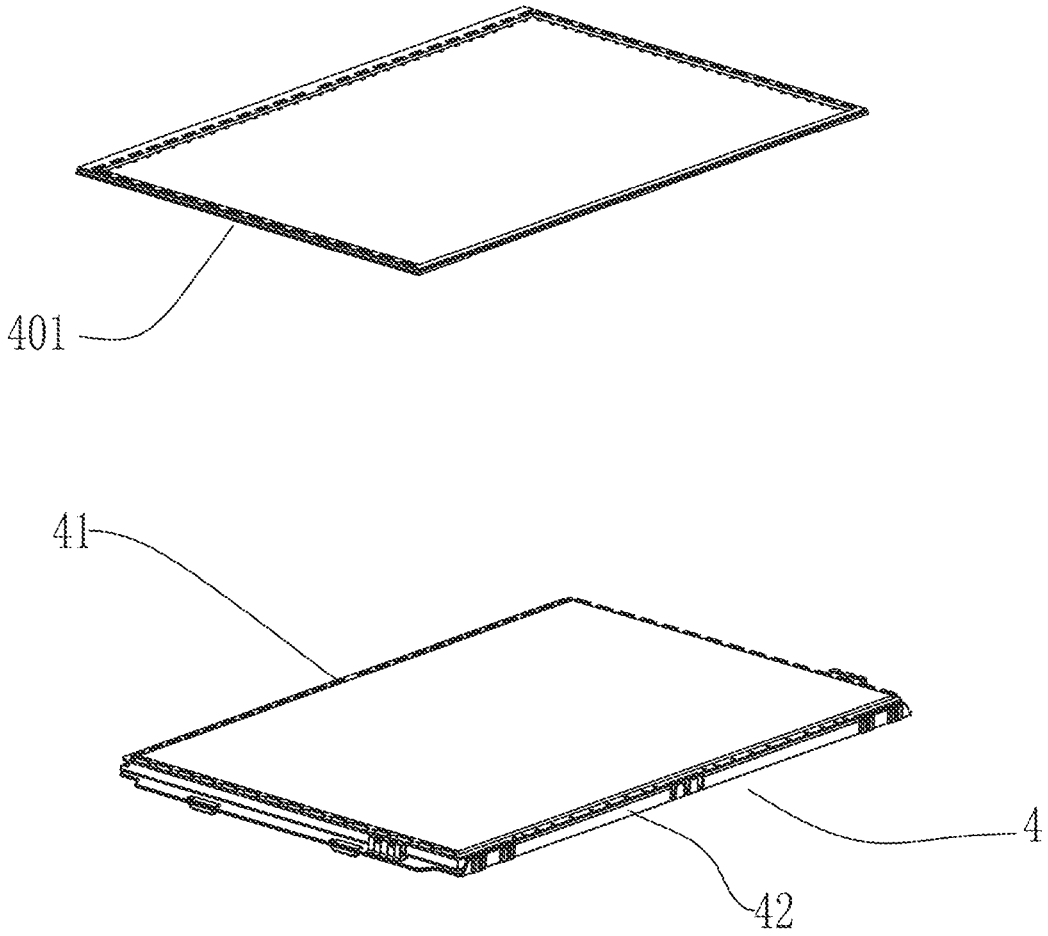
FIG. 19 is a perspective view of the lid and its sealing element of the foldable box according to the present invention.

As shown in FIG. 19, the sealing element 401 between the lid 4 and the side panels 2 and 3 is provided on the outer periphery of the bottom side of the lid 4 and is fixedly connected to the lid 4. Specifically, the sealing element 401 is a rectangular ring in shape and has two pairs of opposite sides. The sealing element 401 is connected to the outer edge of the lid inner plate 44 of the lid 4. The sealing element 401 can be connected to the outer edge of the lid inner plate 44 in any suitable manner. For example, a number of protrusions can be provided on the outer edge of the lid inner plate 44, and a number of complementary grooves can be provided on the sealing element 401, thereby the sealing element 401 is snap-fitted to the lid inner plate 44, or a number of protrusions are provided on the sealing element 401, and complementary recesses are provided on the edge of the lid inner plate 44 for accommodating the aforementioned protrusions. It is also conceivable that a protruding strip may be provided on the sealing element 401, and a complementary groove is provided on the outer edge of the lid inner plate 44, so as to receive and hold the protruding strip.

In a preferred embodiment, the sealing element 401 of the lid 4 has a sealing body 4011 and at least one row of mounting posts 4012 protruding from the sealing body 4011, and the end of each mounting post 4012 is provided with a buckle. Corresponding installation holes are provided on the lid 4, and the buckles are snapped into the installation holes to install the sealing element to the lid.

Figure 20:
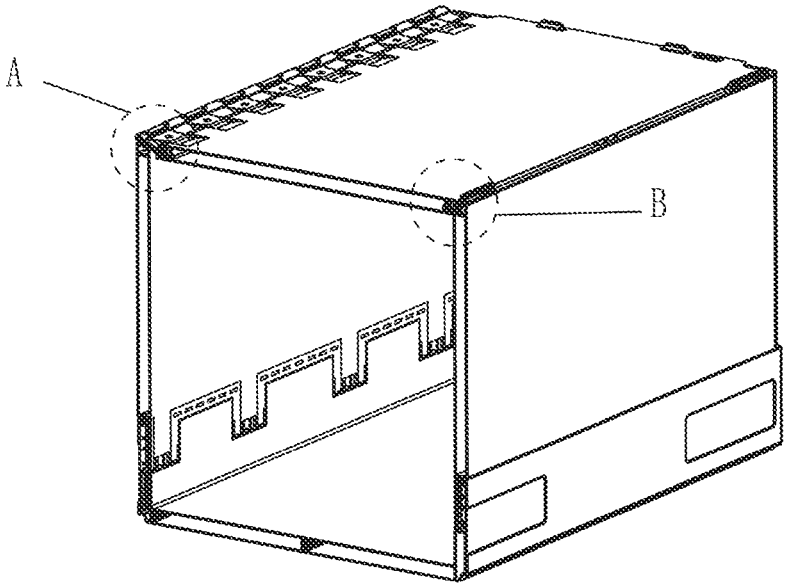
FIG. 20 is a partially cut-away perspective view of a foldable box according to the present invention.

In the preferred embodiment shown in FIG. 20, when the foldable box 100 is in use, when the lid 4 is closed to the top opening, the pair of sides of the sealing element 401 located at the edges 47 and 48 extend beyond the outer edge of the inner plate of the side panel 3, and the side edge located at the lid second edge 42 operatively abuts the side panel 2. Preferably, the inner side of the top end of the side panel 2 that is not hinged with the lid 4 is provided with a groove 2*a* opening upwardly and toward the interior of the box body, the snapping edge 4*a* of the sealing element 401 located at the edge 42 operatively abuts the groove 2*a*, as shown in FIG. 20B.

Figure 20A:
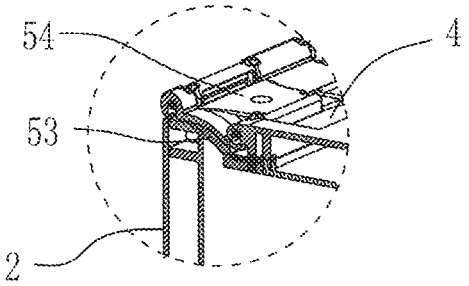
FIG. 20A is an enlarged view of detail A in FIG. 20.
Figure 20B:
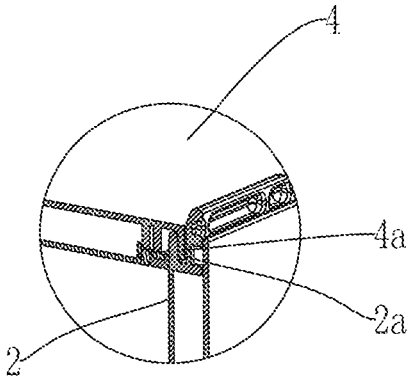
FIG. 20B is an enlarged view of detail B in FIG. 20.
Figure 21:
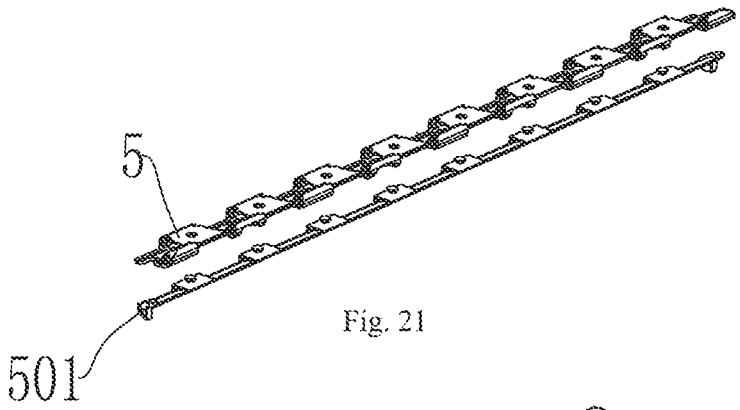
FIG. 21 is a perspective view of a hinge and its sealing element.
Figure 22:
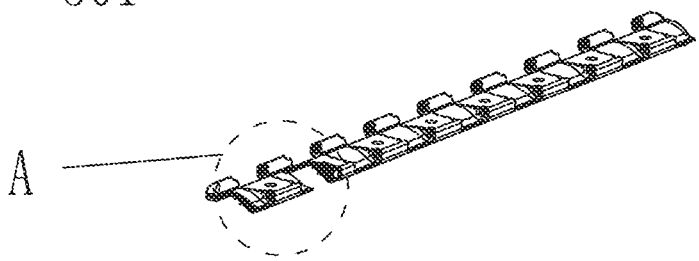
FIG. 22 is a perspective view of a hinge and its sealing element assembled together.
Figure 22A:
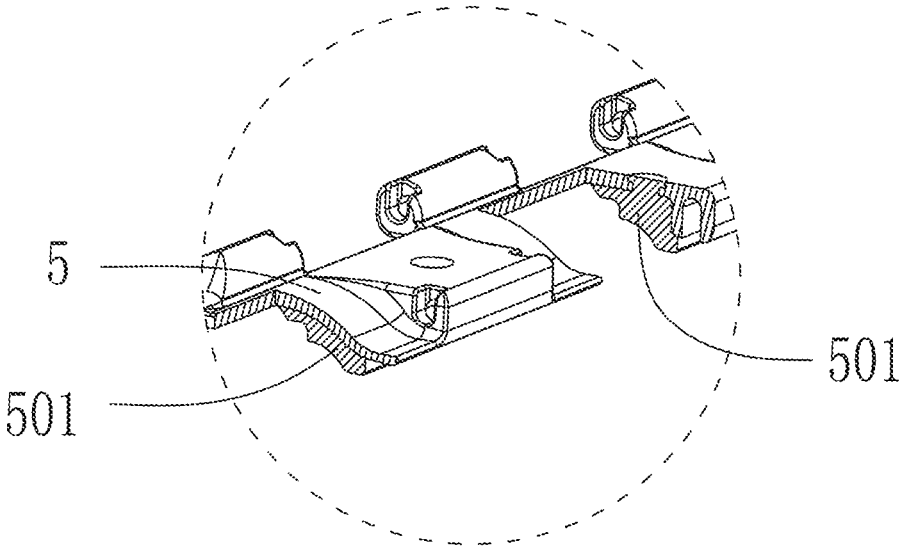
FIG. 22A is an enlarged view of detail A in FIG. 22.

FIG. 20A shows a partial enlarged cross-sectional view in which the lid 4 and one of the side panels 2 are hinged by a hinge 5. As shown in FIGS. 21, 22 and 22A, a hinge sealing element 501 is connected to the underside of the hinge 5, and the first side 5011 of the hinge sealing element 501 operatively abuts against the side panel 2, wherein the first side 5011 is the side of the hinge sealing element 501 away from the lid 4. Preferably, the first side 5011 of the hinge sealing element 501 adjacent to the lid 4 at least partially overlaps with the sealing element 401 on the lid 4.

Figure 15:
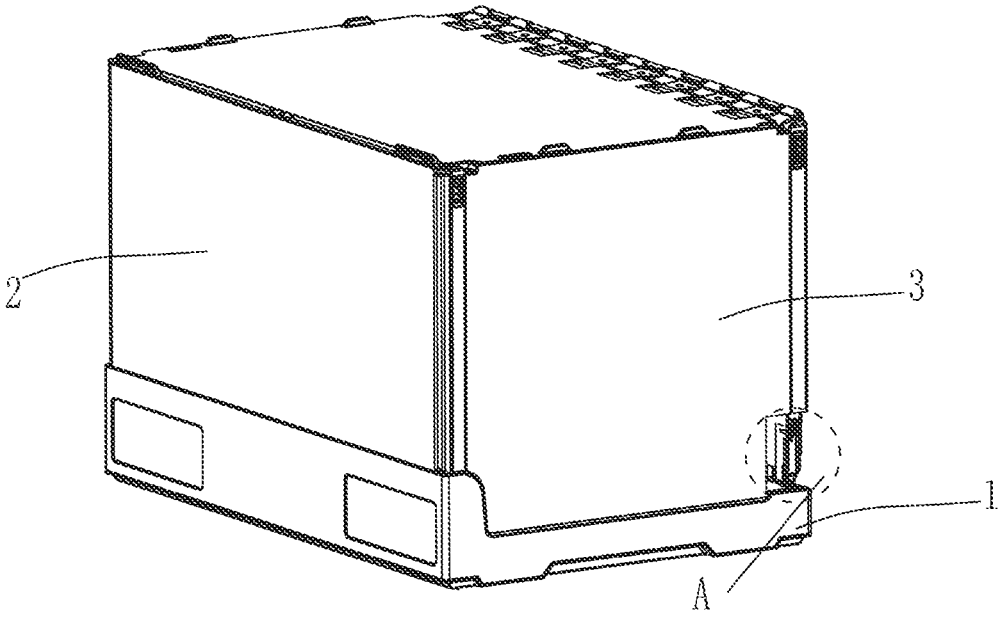
FIG. 15 is another partially cut-away perspective view of the foldable box according to the present invention, in which the bottom end of the side panel is cut away.
Figure 15A:
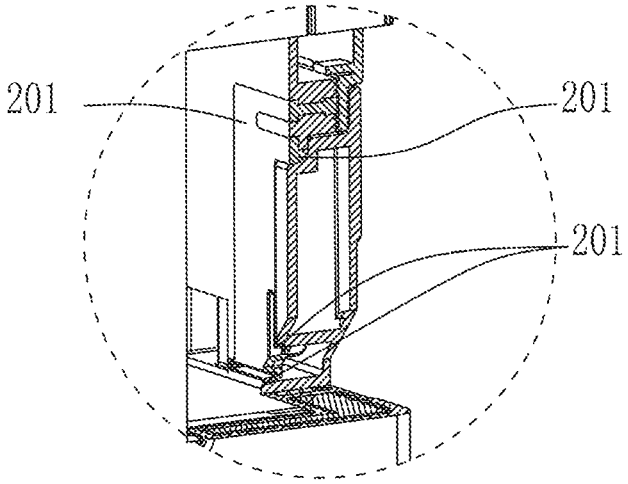
FIG. 15A is an enlarged view of detail A in FIG. 15.
Figure 16:
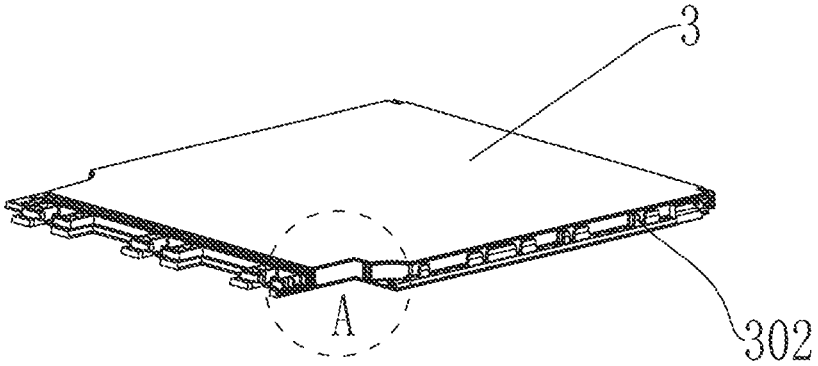
FIG. 16 is another partially cut-away perspective view of the foldable box according to the present invention, in which the bottom end of the side panel is cut away.
Figure 16A:
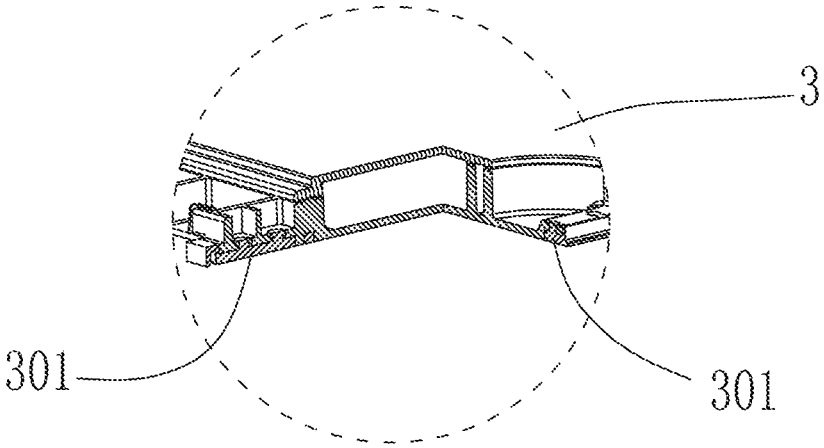
FIG. 16A is an enlarged view of detail A in FIG. 16.

The side panel 2 and the side panel 3 are also provided with sealing elements 201 and 301 respectively. The sealing element 201 of the side panel 2 is shown in FIGS. 15 and 15A, and the sealing element 301 of the side panel 2 is shown in FIGS. 16 and 16A. The side panel 2 and its sealing element 201 as well as the side panel 3 and its sealing element 301 are further shown in FIGS. 17 and 18, respectively.

Figure 14:
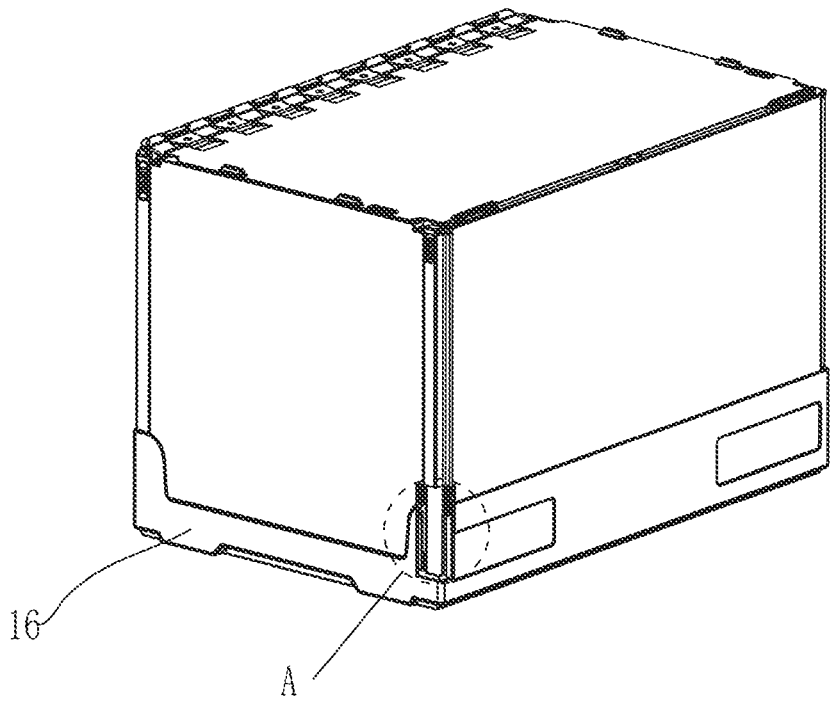
FIG. 14 is another partially cut-away perspective view of the foldable box according to the present invention, in which the intersection of the side panels and the base is cut away.
Figure 14A:
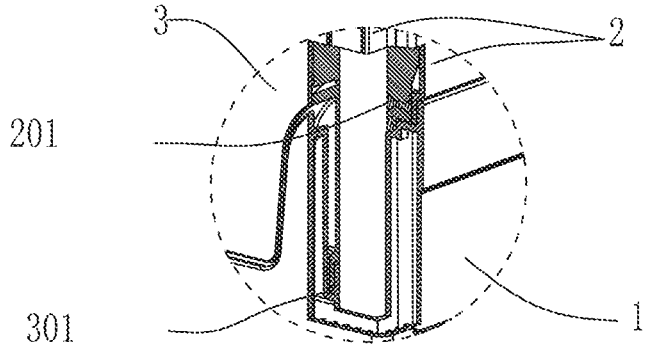
FIG. 14A is an enlarged view of detail A in FIG. 14.

As mentioned above, the bottom end of the side panel 2 is provided with a hinge protruding parts 22 for forming a hinge connection with the pocket 121 in the base 1. Preferably, a hinge protruding part 32 is also provided at the bottom end of the side panel 3, and in order to hingely connect the side panel 3 to the base 1, protruding edges 16 are also provided on the corresponding pair of edges of the base 1, as shown in FIG. 14. A pocket 161 is also provided in the protruding edge 161. The cavity 161 and the hinge protruding parts 32 can adopt the same structure as the pocket 121 and the hinge protruding part 22, respectively, which will not be repeated here.

Figure 17:
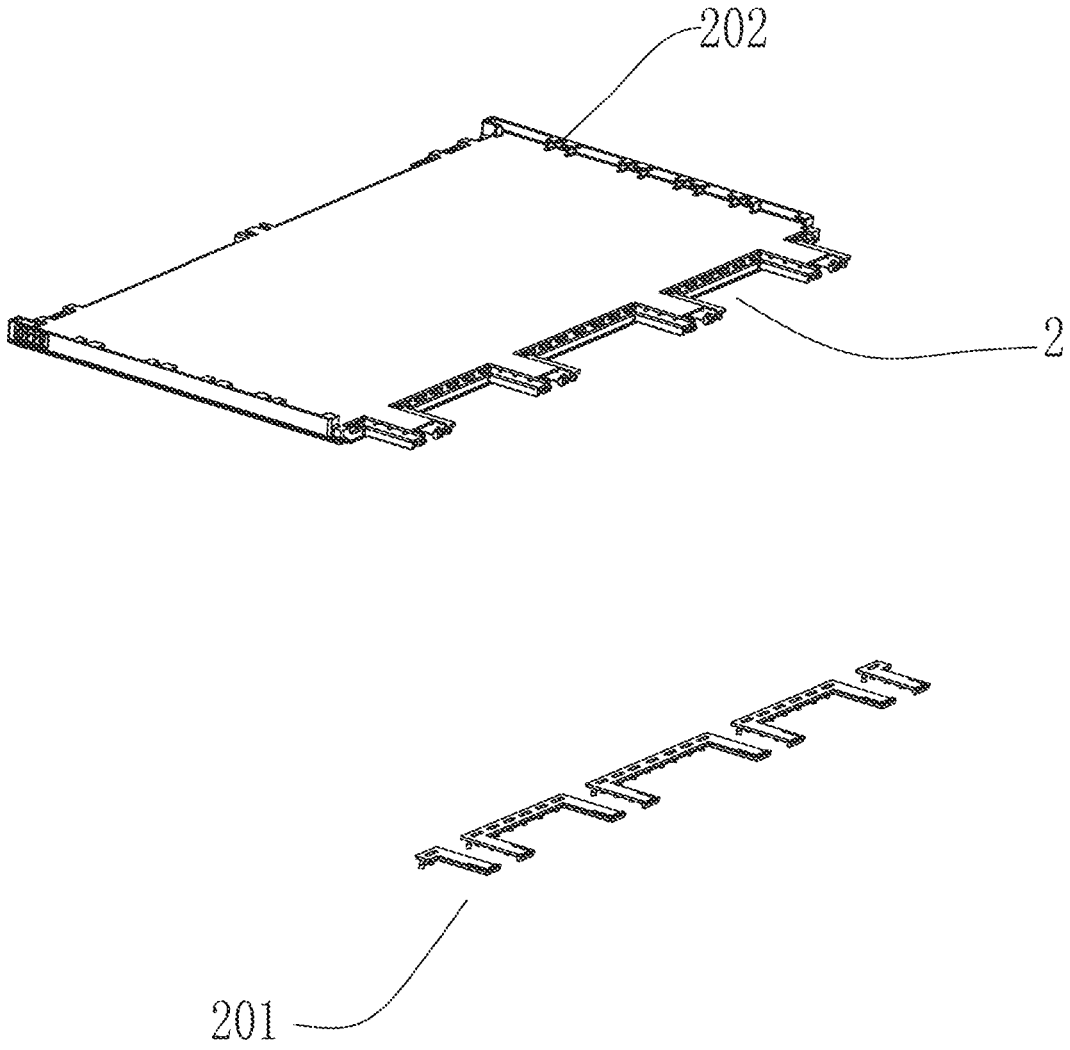
FIG. 17 is a perspective view of a side panel and its sealing element of the foldable box according to the present invention.
Figure 18:
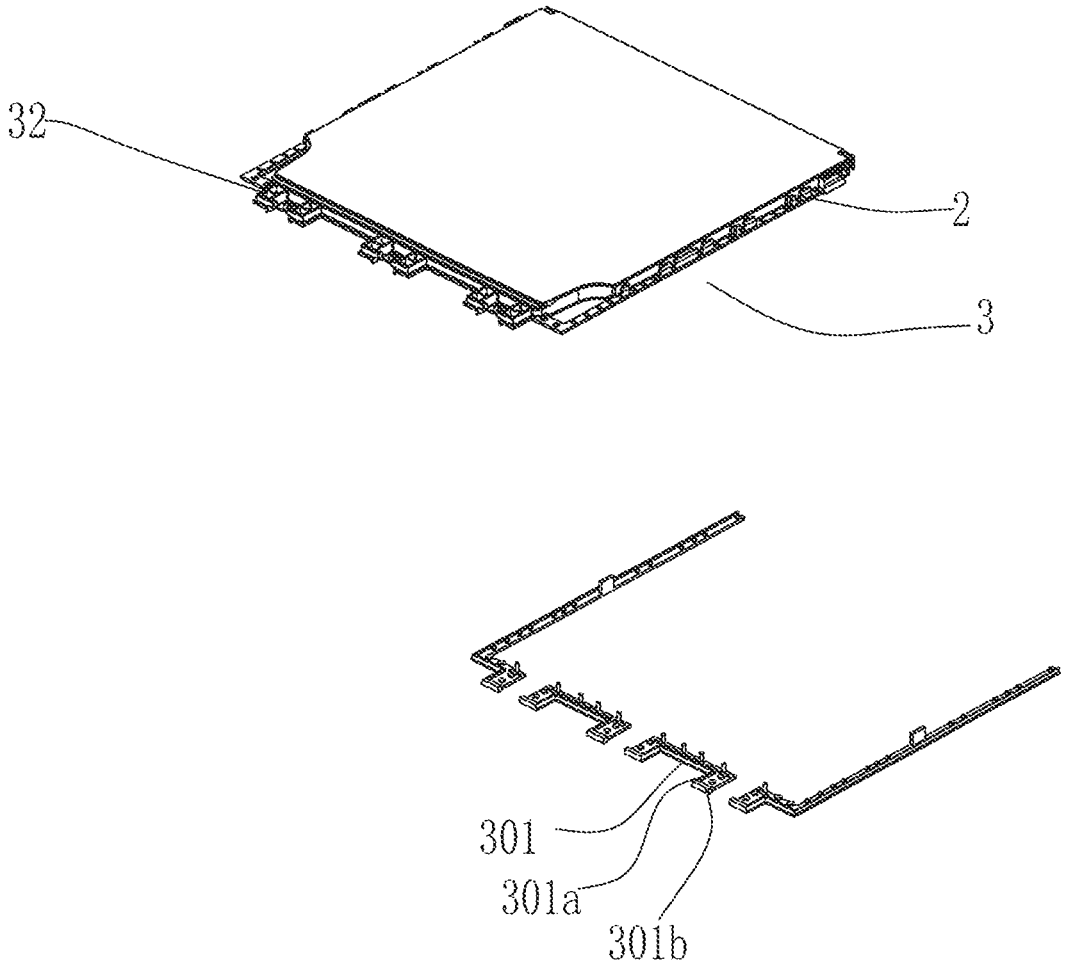
FIG. 18 is a perspective view of the other side panel and its sealing element of the foldable box according to the present invention.

In the embodiment shown in FIGS. 17 and 18, the sealing element 201 of the side panel 2 is only located at the bottom of the side panel 2, while the sealing element 301 of the side panel 3 is in a substantially rectangular ring in shape, including parts respectively located on four edges of the side panel 3. Thus, the sealing between the side panel 2 and the side panel 3 is achieved by the left and right side edge portions of the sealing element 301 of the side panel 3. However, it should be understood that the sealing element 201 of the side panel 2 can also be provided with a substantially rectangular ring in shape, including parts located at the four edges of the side panel 2, and the sealing element 301 of the side panel 3 is only located at the bottom of the side panel 3, thus, the sealing between the side panel 2 and the side panel 3 is realized by the left and right edges of the sealing element 201 of the side panel 2.

Figure 8A:
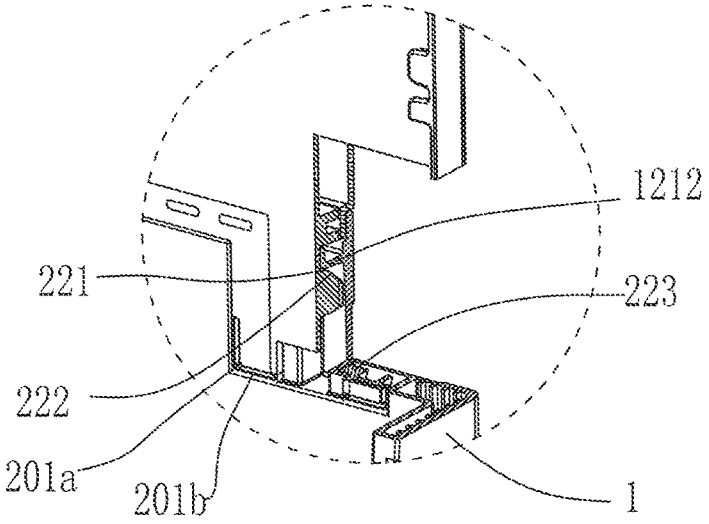
FIG. 8A is an enlarged view of detail A in FIG. 8.

As shown in FIG. 17, the sealing element 201 at the bottom of the side panel 2 includes a plurality of "n"-shaped parts in the middle and half "n"-shaped parts on both sides, wherein the two legs of each n-shaped part respectively cover the inner side surfaces of the two adjacent side panel limiting portions 221 of the two adjacent hinge protrusions 22. Whereas half "n"-shaped parts on both sides cover the inner side surfaces of the side panel limiting portions 221 at the outer end of the hinge protruding parts on the left and right sides The above-mentioned "n"-shaped part and half-"n"-shaped part are sealing elements separated from each other, and the number of "n"-shaped parts is determined according to the number of hinge protrusions 22. Specifically, the sealing element 201 is located on the left and right sides and the lower side of the hinge protrusion and extends beyond the left and right sides and the lower side of the hinge protruding part. As a result, the gaps between the left and right sides of the hinge protruding part and the base protruding edge, as well as the gap between the hinge protruding part and the bottom of the pocket on the base protruding edge, can be effectively sealed, that is, the gaps between the hinge protruding parts and the bottom of the pocket on the base protruding edge can be covered. In one embodiment, the left and right edges of the sealing element installed on the hinge protruding part are provided with vertical grooves 201*a* and is provided with transverse grooves 201*b* at the lower edge thereof, as shown in FIG. 8A.

The part of the sealing element 301 located at the bottom of the side panel 3 has the same structure, and will not be repeated here. The structure of the part of the sealing element 301 extending beyond the left and right sides and the lower side of the hinge portion is shown in FIG. 18, which are flanges 301*a* and 301*b* protruding with respect to the main body of the sealing element. The sealing element 201 has a similar structure. The connection manner between the sealing elements 201 and 301 as well as between the side panels 2 and 3 can be any suitable manner, which can be the installation manner of the sealing element 401 described above. In an embodiment unshown, the sealing element between the bottom of the side panel and the pocket of the base can also be arranged in the pocket of the base, or a sealing element is arranged in both the bottom of the side panel and the pocket of the base. The sealing element between the bottom of the side panel and the pocket of the base is arranged to cover the gap between the hinge protrusion and the bottom of the pocket on the protruding edge of the base.

As mentioned above, in a preferred embodiment, the two longitudinal ends of the side panel 2 and the side panel 3 are respectively provided with engaging portions 202 and 302. When the side panels are erected relative to the base 1, the side panels 2 and 3 are connected by the engaging portions 202 and 302 engaging with each other. The sealing element 301 is connected to the engaging portion 302 of the side panel 3, and the sealing element 301 extends laterally beyond the engaging portion 302, so that the side panel 2 and the side panel 3 can abut against the side panel 2 when the side panel 2 and the side panel 3 are connected to each other in the use state of the foldable box 100 to seal the gap therebetween. The connection between the sealing element 301 and the engaging portion 302 can be achieved in any suitable manner, for example, a plurality of protrusions spaced apart from each other are provided on the elongated plate-shaped body of the sealing element 301 located at the longitudinal edge, and corresponding grooves are provided on the engaging portion 302 of the side panel for operatively fixing the above-mentioned protrusions. In the case where the sealing element 201 includes parts located at the four edges, and the sealing element 301 is only located at the bottom of the side panel 3, the sealing element 201 is connected to the engaging portion 202 of the side panel 2 and extends laterally beyond the engaging portion 202, thereby when the foldable box 100 is in use, the side panel 2 and the side panel 3 connected to each other can be pressed against the side panel 3 to seal the gap therebetween. A plurality of protrusions spaced apart from each other are provided on the elongated plate-shaped body of the sealing element 201 located at the longitudinal edge, and corresponding grooves are provided on the side panel engaging portion 202 for operatively fixing the above-mentioned protrusions.

The hinge 5 and its sealing element 501 are shown in FIG. 20. FIG. 22 shows a perspective view of the hinge 5 and its sealing element 501 assembled together. An enlarged view of detail A of FIG. 22 is shown in FIG. 22A. The sealing element 501 is installed closely below the hinge 5. When the lid 4 closes the opening of the foldable box 100, the sealing element 501 and the sealing element 401 of the lid 4 at least partially overlaps with each other, thereby ensuring the sealing of the gap between the lid 4 and the hinge 5. The connection method between the sealing element 501 and the hinge 5 may be any suitable method, refer to the installation method of the sealing element 401 described above.

The preferred embodiments of the present invention have been described in detail above, but it should be understood that, if necessary, aspects of the embodiments can be modified to adopt aspects, features, and concepts of various patents, applications, and publications to provide additional embodiments.

Considering the detailed description above, these and other variations can be made to the embodiments. Generally, in the claims, the terms used should not be construed as limiting the specific embodiments disclosed in the specification and claims, but should be construed to include all possible embodiments together with all equivalents to which these claims entitled.

The invention claimed is:

1. A foldable box comprising a box body and a lid, wherein the box body has a base and a pair of opposing first side panels and a pair of opposing second side panels, each pair of side panels foldably connected to the base, the lid being operatively connected to a top end of the box body, wherein at least one of the first side panel, the second side panel and the lid consists of an inner plate, an outer plate connected to each other, and a thermal insulation layer being provided between the inner plate and the outer plate, wherein sealing elements are provided between the lid and the first side panels and the second side panels, between the base and the first side panels and the second side panels, and between the first side panels and the second side panels respectively, and wherein a first edge of the lid is hinged to the top end of the box body by a hinge, and the lid is provided with a lid hinge part along the first edge, and the top end of the box body is provided with a side panel hinge part, wherein the hinge has a first edge and a second edge respectively provided with a first main body hinged part and a second main body hinged part, the lid hinged part and the first main body hinged part are hinged to each other, and the side panel hinge part and the second main body hinged part are hinged to each other, wherein a hinge sealing element is connected to the lower side of the hinge, and a first side of the hinge sealing element operatively abuts against the box body.

2. The foldable box according to claim 1, wherein the base has a plate-shaped body and protruding edges extending upwardly from the circumference of the plate-shaped body, and both the plate-shaped body and the protruding edges are provided with a thermal insulation layer.

3. The foldable box according to claim 2, wherein the base is provided with a plate-shaped main body cavity and two pairs of opposing protruding edge cavities, wherein the plate-shaped main body cavity and the protruding edge cavities are spaced apart from each other.

4. The foldable box according to claim 2, wherein the protruding edges are provided with a plurality of cavities spaced apart from each other and facing upwards and toward the interior of the box body, and a thermal insulation layer is arranged within the cavities inside the protruding edges.

5. The foldable box according to claim 1, wherein the inner plate and the outer plate are welded to each other.

6. The foldable box according to claim 5, wherein at least one welding rib is provided on an inner side of an outer peripheral edge of one of the inner plate and the outer plate.

7. The foldable box according to claim 6, wherein the inner side of the outer peripheral edge of one of the inner plate and the outer plate is provided with two welding ribs spaced apart from each other.

8. The foldable box according to claim 1, wherein a cavity for accommodating the thermal insulation layer is formed between a surface of the inner plate and a surface of the outer plate, and surfaces of the inner plate and the outer plate facing the cavity and delimiting the cavity are flat surfaces, or each of the inner plate and the outer plate surfaces facing the cavity and delimiting the cavity are provided with at least one reinforcing rib.

9. The foldable box according to claim 1, wherein a cavity for accommodating the thermal insulation layer is formed between a surface of the inner plate and a surface of the outer plate, and each of the inner plate and the outer plate facing the cavity and delimiting the cavity are provided with at least two reinforcing rib(s), wherein the at least two reinforcing rib(s) are spaced apart from each other and are spaced apart from a welding rib.

10. The foldable box according to claim 9, wherein the welding rib is provided on an inner side of an outer peripheral edge of one of the inner plate and the outer plate, and the at least two reinforcing rib(s) are parallel to the welding rib.

11. The foldable box according to claim 1 wherein at least a part of a second side of the hinge sealing element opposite to the first side overlaps with the sealing element on the first edge of the lid.

12. The foldable box according to claim 1, wherein at least one of the opposing second side panels has a plate-shaped main body and a plurality of hinge protruding parts spaced apart from each other and extending from a lower part of the plate-shaped main body, wherein a bottom end of each hinge protruding part is provided with a side panel hinged part, and left and right side edges of the plate-shaped main body and the side panel hinged part are provided with sealing elements.

13. The foldable box according to claim 1, wherein at least one of the opposing second side panels has a plate-shaped main body wherein the sealing elements between the first side panels and the second side panels are connected with side panel engaging parts of left and right side edges of the plate-shaped main body are both provided with side panel engaging parts, and the side panel engaging parts are connected with the sealing elements between the first side panels and the second side panels, and the sealing elements connected with the side panel engaging parts extend beyond the respective side panel engaging part.

14. The foldable box according to claim 1, wherein the thermal insulation layer is made of plate-shaped material.

15. The foldable box according to claim 1, wherein the thermal insulation layer is composed of composite material layers with different functions.

* * * * *